US008697321B2

(12) United States Patent
Fujii

(10) Patent No.: US 8,697,321 B2
(45) Date of Patent: Apr. 15, 2014

(54) ELECTROPHOTOGRAPHIC PHOTORECEPTOR, IMAGE-FORMING APPARATUS, AND ELECTROPHOTOGRAPHIC CARTRIDGE

(75) Inventor: Akiteru Fujii, Kanagawa (JP)

(73) Assignee: Mitsubishi Chemical Corporation, Tokyo (JP)

( * ) Notice: Subject to any disclaimer, the term of this patent is extended or adjusted under 35 U.S.C. 154(b) by 121 days.

(21) Appl. No.: 13/104,300

(22) Filed: May 10, 2011

(65) Prior Publication Data

US 2011/0294053 A1 Dec. 1, 2011

(30) Foreign Application Priority Data

May 31, 2010 (JP) ..... 2010-124833

(51) Int. Cl.
*G03G 5/047* (2006.01)

(52) U.S. Cl.
USPC ..... 430/58.5; 430/58.85; 430/59.6

(58) Field of Classification Search
USPC ..... 430/58.5, 59.6, 96, 58.85, 58.65; 399/159
See application file for complete search history.

(56) References Cited

U.S. PATENT DOCUMENTS

| | | | | |
|---|---|---|---|---|
| 4,982,014 | A | 1/1991 | Freitag et al. | |
| 5,047,803 | A * | 9/1991 | Kanoto | 399/111 |
| 5,126,428 | A | 6/1992 | Freitag et al. | |
| 5,141,831 | A * | 8/1992 | Itoh et al. | 430/58.45 |
| 5,227,458 | A | 7/1993 | Freitag et al. | |
| 5,312,708 | A | 5/1994 | Terrell et al. | |
| 5,449,572 | A | 9/1995 | Ashiya et al. | |
| 5,554,473 | A | 9/1996 | Cais et al. | |
| 6,001,523 | A | 12/1999 | Kemmesat et al. | |
| 6,215,971 | B1 * | 4/2001 | Sakoh et al. | 399/159 |
| 6,485,658 | B1 * | 11/2002 | Horiuchi et al. | 252/501.1 |
| 6,627,367 | B2 | 9/2003 | Tomiuchi et al. | |
| 7,491,346 | B2 | 2/2009 | Hikosaka | |
| 2001/0033982 | A1 * | 10/2001 | Ishikawa et al. | 430/110.1 |
| 2005/0026058 | A1 * | 2/2005 | Kami et al. | 430/66 |

FOREIGN PATENT DOCUMENTS

| | | | |
|---|---|---|---|
| EP | 0 767 411 A1 | | 4/1997 |
| JP | 9-204053 | | 8/1997 |
| JP | 10-142819 | | 5/1998 |
| JP | 10-186686 | | 7/1998 |
| JP | 10-239871 | | 9/1998 |
| JP | 11-130857 | | 5/1999 |
| JP | 2000-019752 | | 1/2000 |
| JP | 2000-098640 | * | 4/2000 |
| JP | 2001-228637 | | 8/2001 |

OTHER PUBLICATIONS

Derwent absract, Acc. No. 1991-059138, copyright 2013 Thomson Reuters, Patent Family list, which includes US 5,141,831 and JP 03-075660 A.*

Grant, R., et al., ed., Grant & Hackh's Chemical Dictionary, fifth edition, McGraw-Hill Book Company, NY (1987), pp. 27, 49, and 80.*

Diamond, A.S., ed., Handbook of Imaging Materials, Marcel Dekker, Inc., NY (1991), pp. 395-396.*

AIPN Japanese Patent Office machine-assisted English-language translation of JP 2000-098640 (pub. Apr. 2000).*

* cited by examiner

*Primary Examiner* — Janis L Dote
(74) *Attorney, Agent, or Firm* — Oblon, Spivak, McClelland, Maier & Neustadt, L.L.P.

(57) ABSTRACT

When an abutting pressure of the cleaning blade on a photoreceptor is increased, a chattering occurs due to the so-called a stick-slip phenomenon that the blade repeatedly undergoes sticking to the outermost surface of the photoreceptor and slipping thereon. As a result, a possibility of noise generation becomes higher and there is a possibility that toner particles might pass through during slipping to cause a cleaning failure, resulting in a streaky image defect. There is also a higher possibility that the so-called a filming phenomenon might occur, in which a component of the toner sticks to the photoreceptor surface by the action of the blade pressure and becomes difficult to remove, so as to lead to persistent image defects. Furthermore, since the photoreceptor is rotated with toners in the state of being strongly pressed thereagainst, the image defects are apt to be caused due to peripheral-direction scratches. An electrophotographic photoreceptor is provided in which the outermost layer of the photoreceptor contains a specific charge-transporting material and a specific binder resin.

14 Claims, 4 Drawing Sheets

ELECTROPHOTOGRAPHIC PHOTORECEPTOR, IMAGE-FORMING APPARATUS, AND ELECTROPHOTOGRAPHIC CARTRIDGE

FIELD OF THE INVENTION

The present invention relates to an electrophotographic photoreceptor for use in copiers, printers, or the like, and to an image-forming apparatus and a cartridge. More particularly, the invention relates to an electrophotographic photoreceptor, an image-forming apparatus, and a cartridge which are capable of inhibiting the occurrence of troubles such as noise generation, cleaning failures, and occurrence of filming even when a heavy load is imposed on the electrophotographic photoreceptor as in the case where a spherical toner is used and the cleaning blade is abutted on the photoreceptor at an increased pressure.

BACKGROUND OF THE INVENTION

Electrophotography is in extensive use in copiers, printers, and printing machines because of advantages thereof such as, for example, that high-quality images are instantaneously obtained therewith.

With respect to electrophotographic photoreceptors (hereinafter suitably referred to as "photoreceptors"), which are the core of electrophotography, photoreceptors employing an organic photoconductive substance are widely used, the organic photoconductive substances having advantages such as freedom from pollution, ease of film formation, and ease of production.

As a result of the recent desire for higher image quality, the size of toner particles has decreased. In particular, chemical toners often have an approximately spherical shape and hence pose a problem that when toner particles remaining on the photoreceptor are removed with a blade, some toner particles pass through. As a result, the possibility of causing image defects such as background fouling has increased. Consequently, a measure is frequently taken in which the cleaning blade is kept in contact with the photoreceptor at a higher pressure than in conventional apparatus to prevent toner particles from passing through.

DOCUMENT LIST

Patent Documents

[Patent Document 1] Japanese Patent No. 2812729
[Patent Document 2] Japanese Patent No. 3544079
[Patent Document 3] Japanese Patent No. 3144117
[Patent Document 4] JP-A-8-220783
[Patent Document 5] JP-A-6-75389
[Patent Document 6] JP-A-9-204053

SUMMARY OF THE INVENTION

When an abutting pressure of the cleaning blade on a photoreceptor is increased, a chattering occurs due to the so-called a stick-slip phenomenon that the blade repeatedly undergoes sticking to the outermost surface of the photoreceptor and slipping thereon. As a result, a possibility of noise generation becomes higher and there is a possibility that toner particles might pass through during slipping to cause a cleaning failure, resulting in a streaky image defect. There is also a higher possibility that the so-called a filming phenomenon might occur, in which a component of the toner sticks to the photoreceptor surface by the action of the blade pressure and becomes difficult to remove, so as to lead to persistent image defects. Furthermore, since the photoreceptor is rotated with toners in the state of being strongly pressed thereagainst, the image defects are apt to be caused due to peripheral-direction scratches.

The present inventors diligently made investigations in order to overcome those problems. As a result, they have found that by incorporating a specific charge-transporting material and a specific binder resin into the outermost layer of a photoreceptor, the occurrence of troubles such as noise generation, cleaning failures, and occurrence of filming can be inhibited without impairing the other photoreceptor performance. The invention has been thus completed.

Namely, the invention first provides an electrophotographic photoreceptor which comprises an outermost layer comprising: a charge-transporting material represented by the following general formula (1); and a binder resin having a comonomer unit represented by the following general formula (2) and a comonomer unit represented by the following general formula (3):

(1)

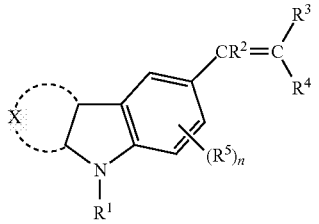

wherein X represents an aliphatic cycloalkyl group; $R^1$ represents an alkyl group, an aralkyl group, or a phenyl group; $R^2$ represents a hydrogen atom, a methyl group, or a phenyl group; $R^3$ and $R^4$ each independently represent a hydrogen atom, an aryl group, or an alkyl group; $R^5$ represents an alkyl group; and n represents an integer of 0-3:

(2)

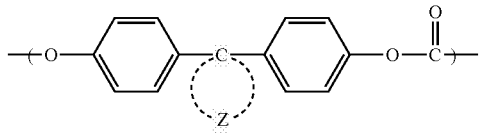

wherein Z forms a saturated aliphatic cycloalkyl group having 5-8 carbon atoms including the carbon atom bonded thereto, and the saturated aliphatic cycloalkyl group having 1-3 methyl groups as substituents:

(3)

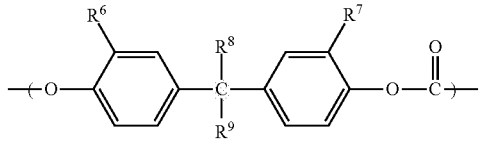

wherein $R^6$ to $R^9$ each independently represent a hydrogen atom or a methyl group.

The invention secondly provides the electrophotographic photoreceptor wherein the binder resin is represented by the following general formula (4):

General Formula (4)

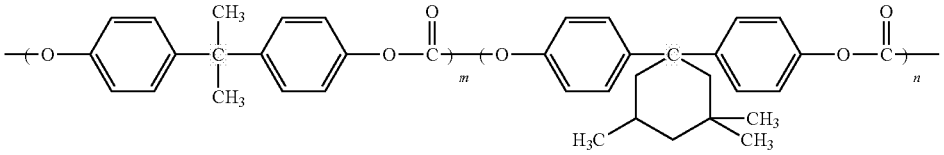

(In general formula (4), m and n represent molar proportion, and m:n is from 90:10 to 10:90.)

The invention thirdly provides an image-forming apparatus comprising the electrophotographic photoreceptor of the invention, wherein the image-forming apparatus comprises:

a charging unit for charging the electrophotographic photoreceptor;

an exposure unit for exposing the charged electrophotographic to light to form an electrostatic latent image;

a development unit for developing the electrostatic latent image with a toner;

a transfer unit for transferring the toner to a receiving object; and a cleaning unit for containing a cleaning blade counter-abutting on the electrophotographic photoreceptor.

The invention fourthly provides the electrophotographic apparatus wherein the toner has an average degree of circularity, as determined with a flow type particle image analyzer, of 0.930-1.000.

The invention fifthly provides an electrophotographic cartridge comprising: the electrophotographic photoreceptor of the invention; a charging unit; and a cleaning unit containing a cleaning blade.

Patent documents 1 and 2 describe a charge-transporting material which falls under the general formula (1) given above. However, these documents include no suggestion about the means for solving problems according to the present invention in the selection of a binder resin. Patent document 3 shows, in an Example, a homopolymer which falls under the general formula (2) according to the invention. However, patent document 3 includes no suggestion about any effect of a copolymer of the monomer or about the means for solving problems according to the present invention on the basis of a combination of the copolymer with a charge-transporting material. Patent document 4 describes a binder resin which falls under copolymers represented by the general formulae (2) and (3) according to the present invention. However, no suggestion is given therein about an index to the solution of problems according to the invention on the basis of the kind of charge-transporting material. Patent document 5 shows, in Example 59, a binder resin which falls under copolymers represented by the general formulae (2) and (3) according to the present invention. However, the charge-transporting material used therewith is an electron-transporting one, in contrast to the charge-transporting material of the invention, which is a hole-transporting one, and no suggestion is given in patent document 5 about the structure of a hole-transporting material and the means for solving problems according to the present invention. Patent document 6 shows combinations of a binder resin which falls under copolymers represented by the general formulae (2) and (3) according to the present invention with various charge-transporting materials. However, the effect which was ascertained therein through Examples is limited to the film loss of the photosensitive layer determined through a printing durability test, and this is not directly related to the means for solving problems according to the present invention.

According to the invention, it is possible to obtain an electrophotographic photoreceptor which does not pose problems such as noise generation due to blade chattering, toner filming, and scratches even when used in processes where an enhanced cleaning blade abutting pressure is employed. An image-forming apparatus, a method of image formation, and an electrophotographic cartridge each using the photoreceptor can also be obtained.

DESCRIPTION OF THE REFERENCE NUMERALS AND SIGNS

Figure 1:
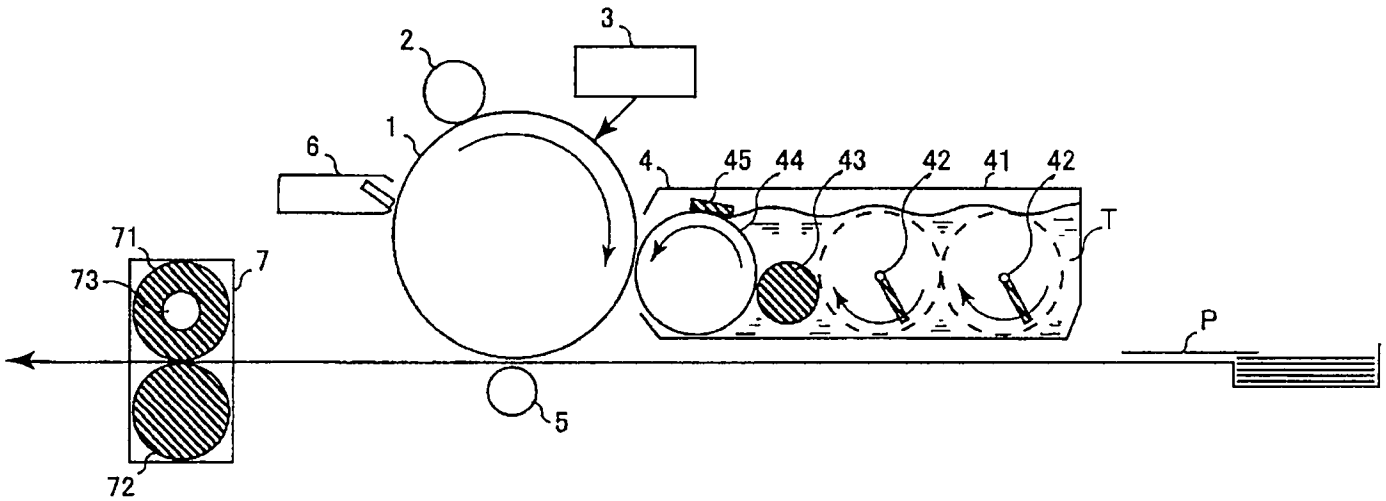
FIG. 1 is a diagrammatic view illustrating the configuration of important parts of one embodiment of the image-forming apparatus of the invention.

1 Photoreceptor
2 Charging unit (device) (charging roller)
3 Exposure unit (device)
4 Developing unit (device)
5 Transfer unit (device)
6 Cleaning unit (device)
7 Fixing unit (device)
41 Developing vessel
42 Agitator
43 Feed roller
44 Developing roller
45 Control member
71 Upper fixing member (pressure roller)
72 Lower fixing member (fixing roller)
73 Heater
T Toner
P Recording paper (paper, medium)

DETAILED DESCRIPTION OF THE INVENTION

Embodiments for carrying out the invention will be explained below in detail. However, the invention should not be construed as being limited to the following embodiments and can be modified at will unless the modifications depart from the spirit of the invention.

First, the charge-transporting material and binder resin to be used in the electrophotographic photoreceptor of the invention are explained.

<Charge-Transporting Material>

As the charge-transporting material to be contained in the photosensitive layer of the electrophotographic photoreceptor of the invention, use is made of a material represented by the following general formula (1), which has the property of transporting holes.

General Formula (1)

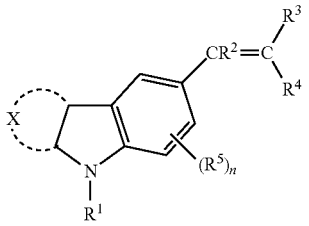

(In general formula (1), X represents a cycloalkyl group; $R^1$ represents an alkyl group or an aryl group; $R^2$ represents a hydrogen atom, a methyl group, or a phenyl group; $R^3$ and $R^4$ each independently represent a hydrogen atom, an aryl group, or an alkyl group; $R^5$ represents an alkyl group; and n represents an integer of 0-3.)

$R^1$ represents an alkyl group or an aryl group. The alkyl group preferably is an alkyl group having 1-5 carbon atoms or a cycloalkyl group having 3-10 carbon atoms. From the standpoint of the universal hardness (which will be described later) of the photoreceptor, an alkyl group having 1-3 carbon atoms is more preferred. The aryl group preferably is phenyl or a phenyl group having one or more substituents. From the standpoint of the electrical properties and mechanical properties of the photoreceptor, a phenyl group having one or two substituents is more preferred. Examples of the substituents include alkyl groups having 1-3 carbon atoms and alkoxy groups having 1-3 carbon atoms. From the standpoint of mechanical properties, methyl or methoxy is preferred.

X represents a cycloalkyl group, and usually is a cycloalkyl group having 3-10 carbon atoms. From the standpoint of mechanical properties, X preferably is a cycloalkyl group having 5-7 carbon atoms, and more preferably is cyclopentyl.

$R^2$ represents a hydrogen atom, methyl, or phenyl.

$R^3$ and $R^4$ each independently represent a hydrogen atom, an aryl group, or an alkyl group. Examples of the aryl group include phenyl, naphthyl, and phenyl groups having one or more substituents. Of these, phenyl and substituted phenyl groups are preferred from the standpoint of mechanical properties. Examples of the substituents include alkyl groups, alkoxy groups, and halogen radicals. The alkyl groups are alkyl groups having 1-3 carbon atoms, and methyl is preferred. The alkoxy groups are alkoxy groups having 1-3 carbon atoms, and methoxy is preferred. The halogen radicals are bromo, chloro, and fluoro, and chloro is preferred. Of these substituents of the phenyl group, a hydrogen atom or methyl is especially preferred from the standpoint of electrical properties. On the other hand, the alkyl group may be an alkyl group having 1-5 carbon atoms. From the standpoint of mechanical properties, the alkyl group preferably is an alkyl group having 1-3 carbon atoms, and more preferably is methyl or ethyl.

$R^5$ represents an alkyl group. $R^5$ generally is an alkyl group having 1-5 carbon atoms, preferably is an alkyl group having 1-3 carbon atoms, and more preferably is methyl or ethyl.

Symbol n represents an integer of 0-3. From the standpoints of electrical properties and mechanical properties, n is preferably 0-1, especially preferably 0. When n is 2 or larger, the $R^5$s may be different from each other.

The charge-transporting material represented by general formula (1) does not have a triphenylamine unit unlike many other charge-transporting materials, and instead has a fused-ring portion having a saturated cycloalkyl moiety. This charge-transporting material hence has a small molecular volume. The small molecular volume, coupled with the presence of the saturated cycloalkyl moiety at the outer edge of the molecule, enables the charge-transporting material to have high compatibility with the binder resin to be used in the invention, which also has a saturated cycloalkyl moiety, and be specifically effective in filling the free volume of the resin. The resultant advantage is that the photoreceptor has an increased surface hardness. From the standpoint of filling the free volume, the molecular weight of the charge-transporting material is preferably 500 or lower, more preferably 450 or lower, most preferably 430 or lower. On the other hand, too low molecular weights result in the possibility that the charge-transporting material might sublimate and disappear in a drying step after application. Consequently, the molecular weight thereof is preferably 300 or higher, more preferably 350 or higher.

Preferred examples of general formula (1) are shown below.

(1)-1

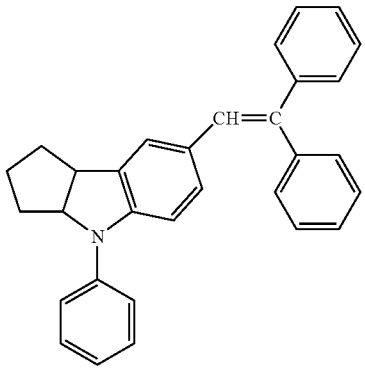

(1)-2

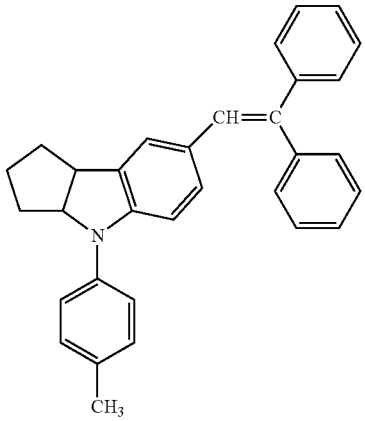

-continued
(1)-3
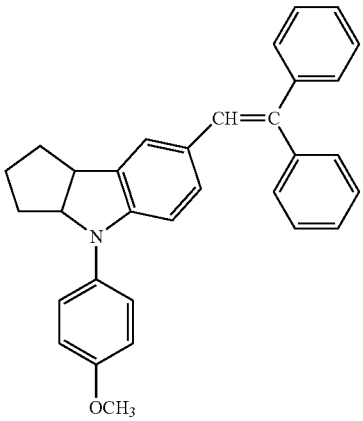
(1)-4
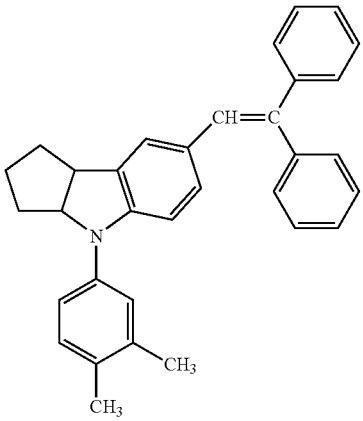
(1)-5
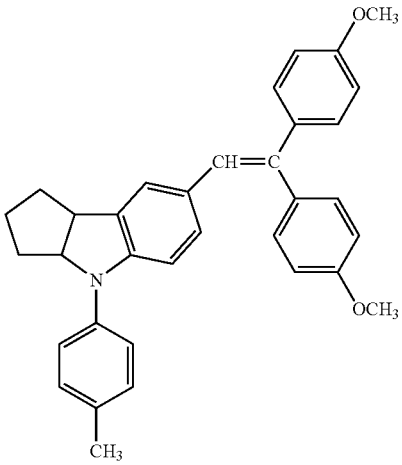
-continued
(1)-6
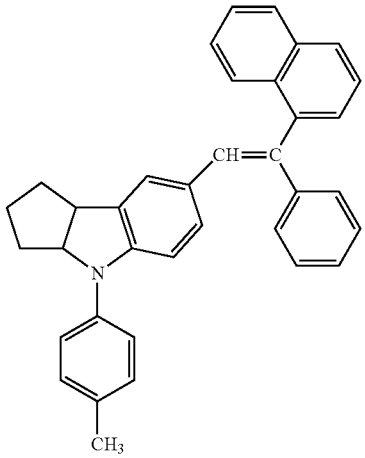
(1)-7
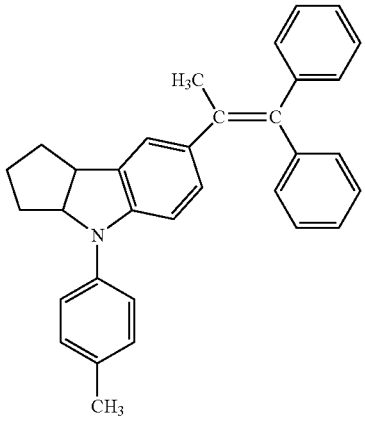
(1)-8
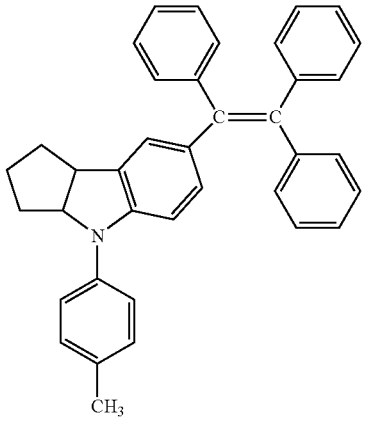

-continued
(1)-9
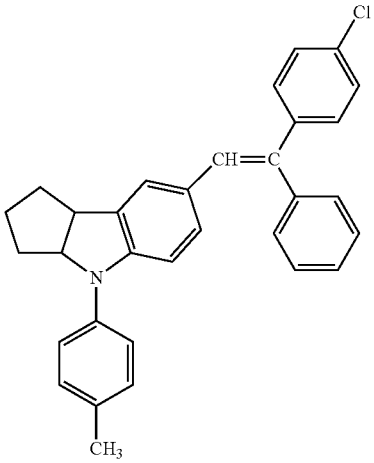
(1)-10
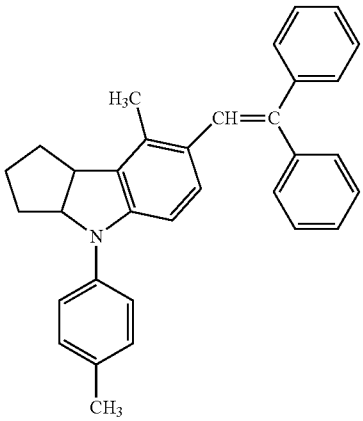
(1)-11
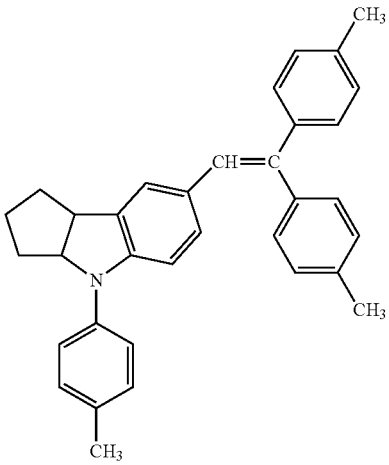
-continued
(1)-12
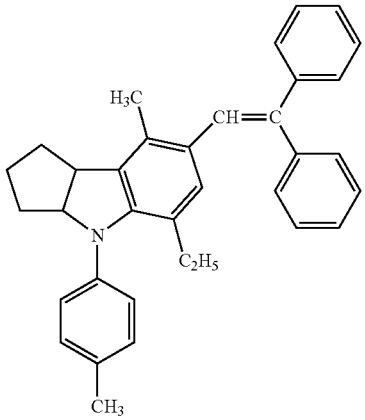
(1)-13
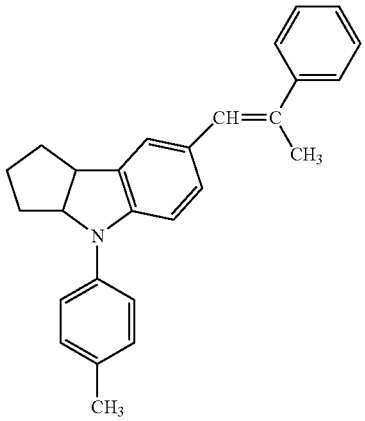
(1)-14
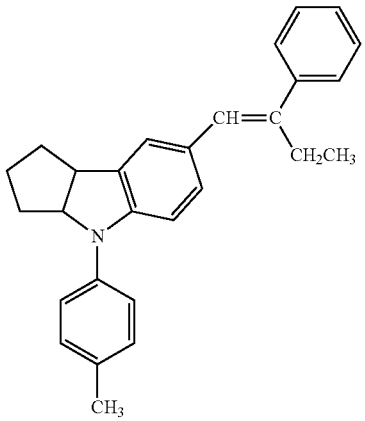

-continued
(1)-15
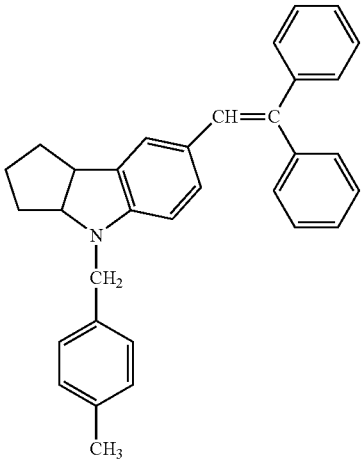
(1)-16
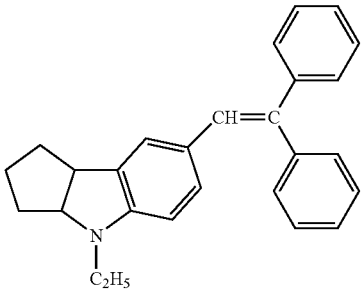
(1)-17
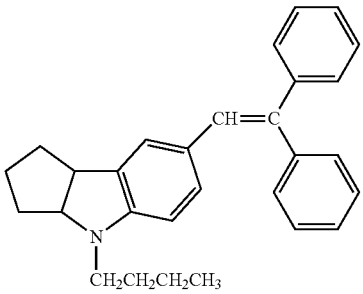
(1)-18
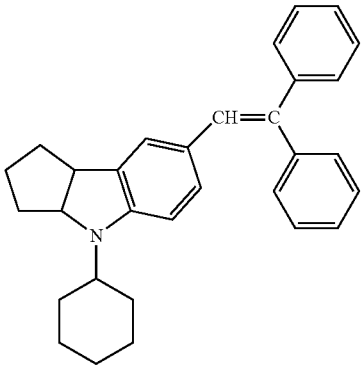
-continued
(1)-19
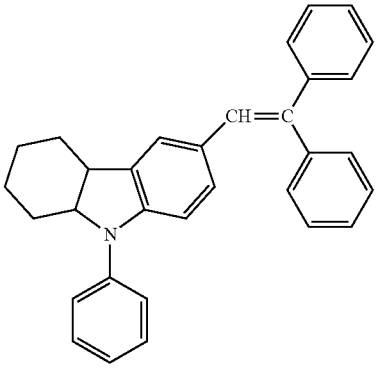
(1)-20
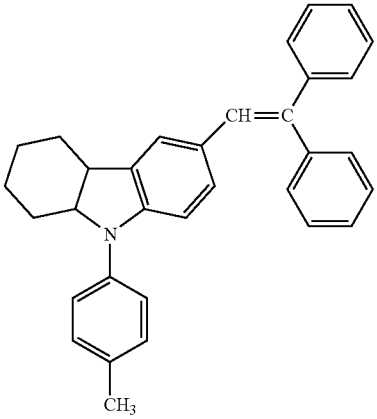
(1)-21
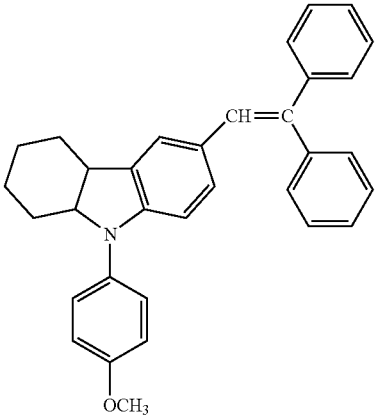
(1)-22
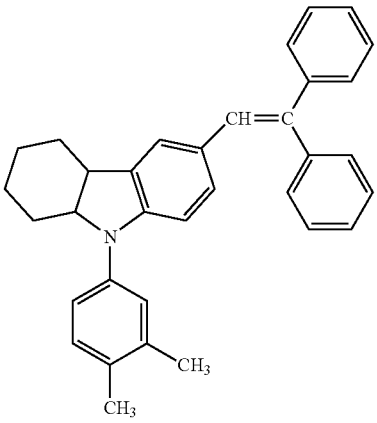

-continued (1)-23

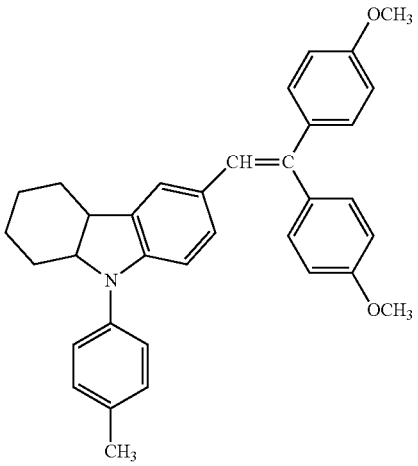

(1)-24

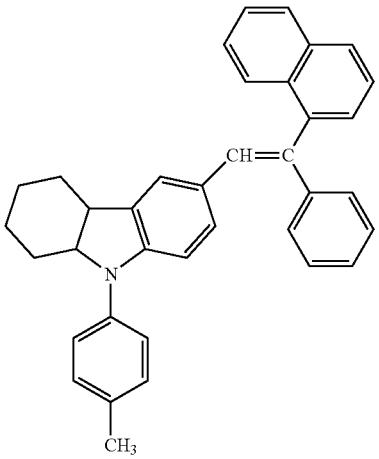

(1)-25

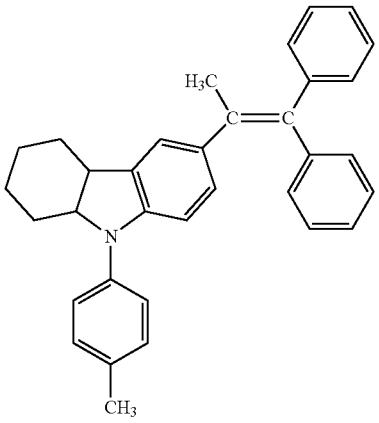

-continued (1)-26

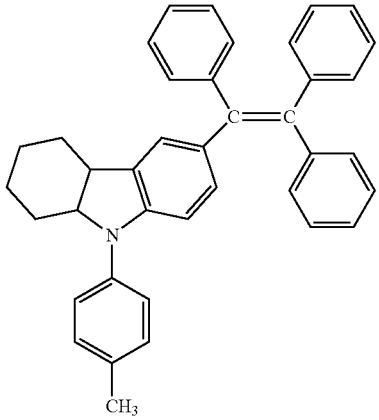

(1)-27

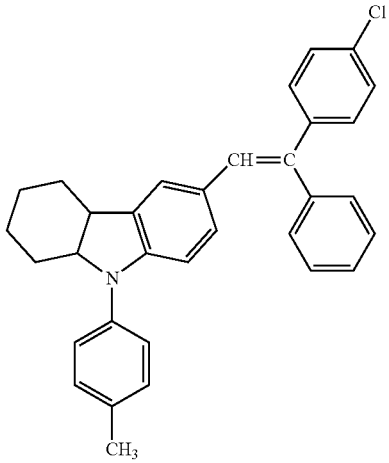

<Binder Resin>

In the photosensitive layer of the electrophotographic photoreceptor of the invention, a binder resin having both a structural unit represented by the following general formula (2) and a structural unit represented by the following general formula (3), as comonomer units, is contained in the outermost layer in which the charge-transporting material also is contained.

General Formula (2)

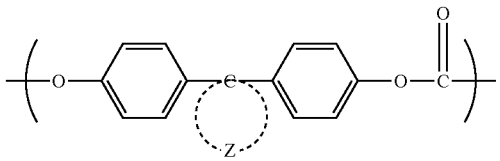

In general formula (2), Z forms a saturated aliphatic cycloalkyl group having 5-8 carbon atoms including the carbon atom bonded thereto, and the saturated aliphatic cycloalkyl group has 1-3 methyl groups as substituents. Preferred examples of general formula (2) are shown below. The introduction of 1-3 methyl groups reduces the structural flexibility of the cycloalkyl group to enhance the stiffness of the resin. For example, the homopolymer (2)-6 shown below has a Tg as high as 245° C., whereas the corresponding homopolymer having no methyl substituent (common name:

bisphenol Z polycarbonate) has a Tg of 180° C. Furthermore, asymmetrically introducing one or more methyl groups has an advantage that the binder resin has further enhanced solubility and troubles such as coating-fluid gelation are inhibited.

(2)-1

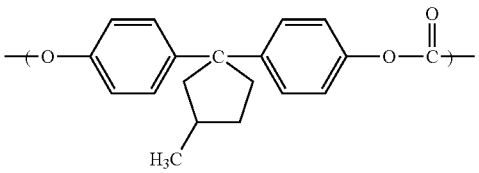

(2)-2

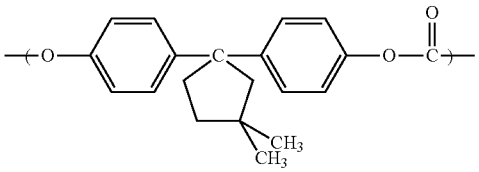

(2)-3

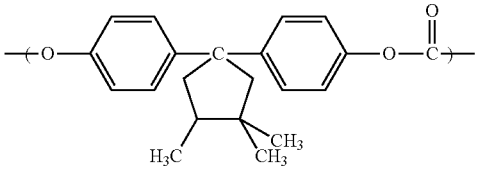

(2)-4

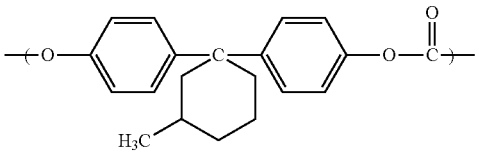

(2)-5

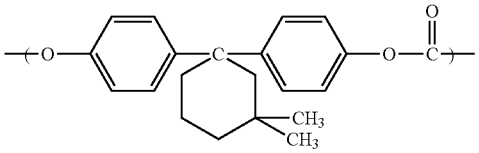

(2)-6

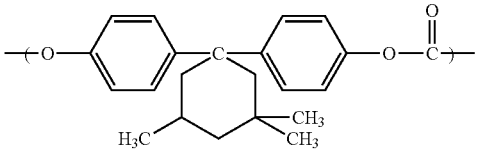

(2)-7

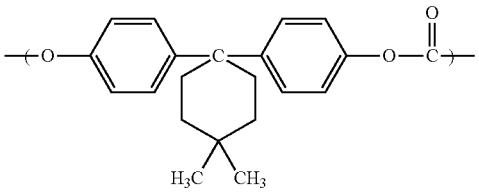

(2)-8

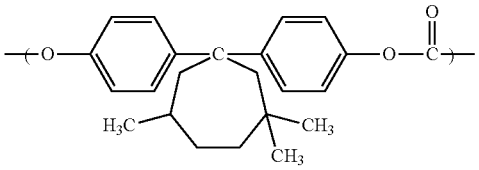

From the standpoints of mechanical properties and ease of resin production, (2)-5 and (2)-6 are preferred of those, and (2)-6 is most preferred. Although the resin represented by general formula (2) is inhibited by the methyl substitution from undergoing conformational transitions of the cyclohexyl unit (transitions between boat form and chair form) and hence has an elevated Tg, this resin has a larger free volume, i.e., a larger volume of interstices between polymer molecules, than the resin having no methyl substituents, because of the rigid molecular structure. It is therefore presumed that the charge-transporting material represented by general formula (1), which has a saturated cycloalkyl moiety, is apt to specifically fill the free volume as stated above.

General Formula (3)

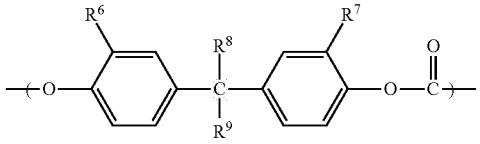

In general formula (3), $R^6$ to $R^9$ each independently represent a hydrogen atom or methyl.

Preferred examples of general formula (3) are shown below.

(3)-1

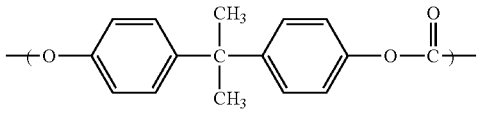

(3)-2

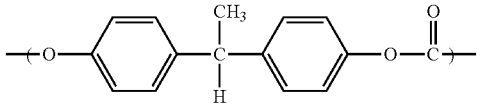

(3)-3

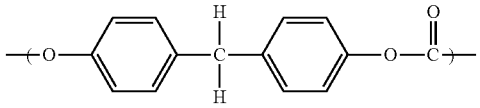

(3)-4

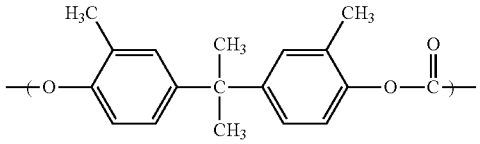

(3)-5

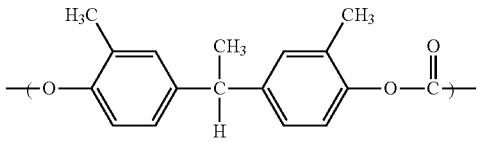

(3)-6

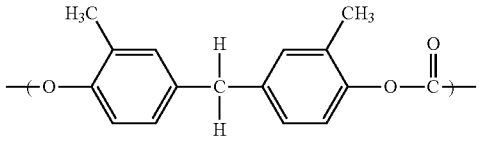

Homopolymers of general formula (2) have an exceedingly high Tg as described above, and are hence undesirable from the standpoints of compatibility with the charge-transporting material, adhesion to bases, etc. in photoreceptor applications. On the other hand, homopolymers of general formula (3) have a relatively low Tg. For example, the homopolymer of (3)-1 has a Tg of about 150° C. Consequently, by copolymerizing general formula (2) with general formula (3), the resultant copolymer can be regulated so as to have a moderate Tg. From the standpoint of mechanical properties, (3)-1 and (3)-4 are preferred of those examples, and (3)-1 is most preferred.

The copolymerization ratio of general formula (2) to general formula (3) is preferably from 10:90 to 90:10, more preferably from 10:90 to 50:50, most preferably from 15:85 to 33:67.

It is especially preferred that the copolymer resin having structural units represented by general formula (2) and general formula (3) should be represented by the following general formula (4).

General Formula (4)

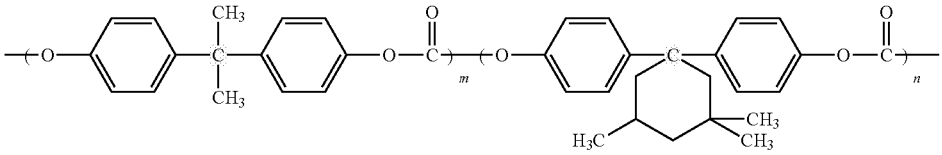

In general formula (4), m and n represent molar proportion, and m:n is generally from 90:10 to 10:90, preferably from 90:10 to 50:50, most preferably from 85:15 to 67:33.

The molecular weight thereof, in terms of weight-average molecular weight (calculated for standard polystyrene), is preferably 30,000-200,000, more preferably 40,000-100,000.

The electrophotographic photoreceptor of the invention is further explained below with respect to other constituent elements.

The photoreceptor of the invention is equipped with an outermost layer containing the specific charge-transporting material and binder resin described above. The photoreceptor of the invention usually comprises a conductive substrate (also called "conductive base") and photosensitive layer formed on the conductive substrate.

[I-1. Conductive Substrate]

As the conductive substrate, use can be made of the known materials disclosed in JP-A-2007-293319, such as, for example, aluminum and aluminum alloys.

In the case where a metallic material, e.g., an aluminum alloy, is employed as the conductive substrate, this metallic material may be used after an anodized coating is formed thereon as disclosed in JP-A-2007-293319.

[I-2. Undercoat Layer]

An undercoat layer may be disposed between the conductive substrate and the photosensitive layer in order to improve adhesion, nonblocking properties, etc.

As the undercoat layer, the known undercoat layer disclosed in JP-A-2007-293319 can be used.

[I-3. Photosensitive Layer]

A photosensitive layer is formed over the conductive substrate described above (when the undercoat layer described above has been disposed, the photosensitive layer is formed on the undercoat layer). The photosensitive layer is a layer containing both the charge-transporting material specified in the invention and the binder resin specified in the invention. Examples of types thereof include: photosensitive layers of a single-layer structure in which a charge-generating material and a charge-transporting material (including the charge-transporting material specified in the invention) are present in the identical layer in the state of being dispersed in a binder resin (including the binder resin specified in the invention) (hereinafter, this type of photosensitive layer is suitably referred to as "single-layer type photosensitive layer"); and function allocation type photosensitive layers of a multilayer structure composed of two or more layers including a charge-generating layer in which a charge-generating material has been dispersed in a binder resin and a charge-transporting layer in which a charge-transporting material (including the charge-transporting material specified in the invention) has been dispersed in a binder resin (including the binder resin specified in the invention) (hereinafter, this type of photosensitive layer is suitably referred to as "multilayer type photosensitive layer"). The photosensitive layer may be of either type.

Multilayer type photosensitive layers include: a normal multilayer type photosensitive layer obtained by forming and superposing a charge-generating layer and a charge-transporting layer in this order from the conductive-substrate side; and a reverse multilayer type photosensitive layer obtained by forming and superposing a charge-transporting layer and a charge-generating layer in this order from the conductive-substrate side. Although either type can be employed, the normal multilayer type photosensitive layer is preferred because this layer can exhibit most balanced photoconductivity.

<Function Allocation Type Photosensitive Layer>

<Charge-Transporting Layer>

When the charge-transporting layer of a function allocation type photoreceptor having a charge-generating layer and a charge-transporting layer is formed, a binder resin is used in order to ensure film strength.

In the case of the charge-transporting layer of a function allocation type photoreceptor, a coating fluid obtained by dissolving or dispersing a charge-transporting substance and any of various binder resins in a solvent is applied and dried. In the case of a single-layer type photoreceptor, a coating fluid obtained by dissolving or dispersing a charge-generating substance, a charge-transporting substance, and any of various binder resins in a solvent is applied and dried. Thus, the desired layer can be obtained.

<Binder Resin>

In the case where the electrophotographic photoreceptor of the invention is a function allocation type photoreceptor, the binder resin to be used for the charge-transporting layer includes a binder resin having both a structural unit represented by general formula (2) and a structural unit represented by general formula (3) as comonomer units. The binder resin may be a mixture of the binder resin according to the invention and one or more other resins unless this mixture lessens the effects of the invention. Examples of the other resins include polymers and copolymers of vinyl compounds, such as butadiene resins, styrene resins, vinyl acetate resins, vinyl chloride resins, acrylic ester resins, methacrylic ester resins, vinyl alcohol resins, and ethyl vinyl ether resins, and further include poly(vinyl butyral) resins, poly(vinyl formal) resins, partly modified poly(vinyl acetal), polycarbonate resins, polyester resins, polyarylate resins, polyamide resins, polyurethane resins, cellulose ester resins, phenoxy resins, silicone resins, silicone-alkyd resins, and poly-N-vinylcarbazole resins. These binder resins can be crosslinked, before use, with heat, light, etc. with the aid of an appropriate hardener, or may have been modified with a silicon reagent or the like.

<Charge-Transporting Material>

The electrophotographic photoreceptor of the invention contains a charge-transporting material which includes a charge-transporting material represented by general formula (1). A single charge-transporting substance according to the invention represented by general formula (1) may be used alone, or two or more charge-transporting substances represented by general formula (1) may be used in combination in any desired proportion. In addition to such charge-transporting substance(s) according to the invention represented by general formula (1), other known charge-transporting substances may be used in combination therewith unless this lessens the effects of the invention.

The charge-transporting material according to the invention represented by general formula (1) may be used in any desired amount unless the effects of the invention are lessened. However, too small amounts thereof are disadvantageous for charge transport and result in impaired electrical properties. Consequently, the amount of the charge-transporting material is generally 30 parts by weight or more, preferably 40 parts by weight or more, per 100 parts by weight of the binder resin present in the photosensitive layer. On the other hand, too large amounts thereof may result in an excessively low glass transition point (Tg) and deteriorated wear resistance. Consequently, the amount thereof is generally 200 parts by weight or less, preferably 150 parts by weight or less.

<Charge-Generating Layer>

The charge-generating layer of a multilayer type photosensitive layer (function allocation type photosensitive layer) contains a charge-generating material and usually further contains a binder resin and other ingredients which are used according to need. This charge-generating layer may be obtained, for example, in the following manner. Fine particles of a charge-generating material and a binder resin are dissolved or dispersed in a solvent or a dispersion medium to produce a coating fluid. This coating fluid is applied to a conductive substrate (or to an undercoat layer when the undercoat layer has been disposed) and dried in the case of a normal multilayer type photosensitive layer, or is applied to a charge-transporting layer and dried in the case of a reverse multilayer type photosensitive layer. Thus, a charge-generating layer can be obtained.

<Charge-Generating Material>

Usable examples of the charge-generating material include the known charge-generating materials disclosed in JP-A-2007-293319. Preferred of these materials are metal-containing phthalocyanines in which a metal is contained at the center of the phthalocyanine ring. More preferred of the metal-containing phthalocyanines are A-form (β-form), B-form (α-form), and D-form (Y-form) oxytitanium phthalocyanines, II-form chlorogallium phthalocyanine, V-form hydroxygallium phthalocyanine, G-form μ-oxogallium phthalocyanine dimer, and the like. More preferred are A-form (β-form), B-form (α-form), and D-form (Y-form) oxytitanium phthalocyanines.

Especially preferred is oxytitanium phthalocyanine which has a main distinct diffraction peak at a Bragg angle (2θ±0.2°) of 27.2° in an X-ray powder diffraction spectrum obtained with CuKα characteristic X rays.

It is preferred that the oxytitanium phthalocyanine should have a distinct diffraction peak at a Bragg angle (2θ±0.2°) of 9.0°-9.7° in an X-ray powder diffraction spectrum obtained with CuKα characteristic X rays.

In the case where an azo pigment is used as a charge-generating material, various known bisazo pigments and trisazo pigments are suitable.

There are cases where a preferred charge-generating material to be used is determined by the wavelength of the exposure light to be used. When the wavelength of the exposure light is in a short-wavelength region of about 380-500 nm, those azo pigments are suitable for use. On the other hand, when near infrared light having a wavelength of about 630-780 nm is used, the phthalocyanine pigments having high sensitivity also in that region and some of the azo pigments are suitable. Also in the case where environmental characteristics, such as, for example, a small dependence on humidity, are desired, those azo pigments are suitable because the oxytitanium phthalocyanine having a distinct diffraction peak at a Bragg angle (2θ±0.2°) of 9.0°-9.7° in an X-ray powder diffraction spectrum obtained with CuKα characteristic X rays has a large dependence on humidity.

It is desirable that the particle diameter of the charge-generating material to be used should be sufficiently small. Specifically, the particle diameter thereof is generally 1 μm or smaller, preferably 0.5 μm or smaller.

With respect to the amount of the charge-generating material to be dispersed in the photosensitive layer, too small amounts thereof result in a possibility that sufficient sensitivity might not be obtained. Too large amounts thereof may result in adverse influences such as a decrease in electrification characteristics, a decrease in sensitivity, and a decrease in smoothness due to aggregation. Consequently, the amount of the charge-generating material in the charge-generating layer of the multilayer type photosensitive layer is generally 20% by weight or more, preferably 40% by weight or more, and is generally 90% by weight or less, preferably 70% by weight or less.

<Binder Resin>

The binder resin to be used in the charge-generating layer as a component of the multilayer type photosensitive layer is not particularly limited. For example, the known binder resin materials disclosed in JP-A-2007-293319 can be used.

Specifically, the charge-generating layer may be formed by dissolving any of those binder resins in an organic solvent, dispersing a charge-generating substance in the resultant solution to prepare a coating fluid, and applying the coating fluid to a conductive substrate (or to an undercoat layer when the undercoat layer has been disposed).

<Single-Layer Type Photosensitive Layer>

A single-layer type photosensitive layer is formed using a charge-generating substance and a charge-transporting substance and further using, as in the case of the charge-transporting layer of a function allocation type photoreceptor, a binder resin having both a structural unit represented by general formula (2) and a structural unit represented by general formula (3) as comonomer units. Specifically, a single-layer type photosensitive layer can be obtained by dissolving or dispersing a charge-generating substance, a charge-transporting substance, and the binder resin in a solvent to produce a coating fluid, applying the coating fluid to a conductive substrate (or to an undercoat layer when the undercoat layer has been disposed), and drying the coating.

The kinds of the charge-transporting substance and binder resin and the proportions thereof are the same as explained above with regard to the charge-transporting layer of a multilayer type photoreceptor. A charge-generating substance is further dispersed in a charge-transporting medium constituted of the charge-transporting substance and binder resin.

As the charge-generating substance, use can be made of the same charge-generating substances as those explained above with regard to the charge-generating layer of a multilayer type photoreceptor. However, in the case of the photosensitive layer of a single-layer type photoreceptor, it is necessary to employ a charge-generating substance having a sufficiently reduced particle diameter. Specifically, the particle diameter thereof is regulated so as to be in the range of generally up to 1 μm, preferably up to 0.5 μm.

With respect to the amount of the charge-generating substance to be dispersed in the single-layer type photosensitive layer, too small amounts thereof make it impossible to obtain sufficient sensitivity. On the other hand, too large amounts thereof may result in adverse influences such as a decrease in electrification characteristics and a decrease in sensitivity. Consequently, the charge-generating substance is used in an amount which is generally 0.5% by mass or more, preferably 1% by mass or more, and is generally 50% by mass or less, preferably 20% by mass or less, based on the whole single-layer type photosensitive layer.

With respect to the proportions of the binder resin and the charge-generating substance in the single-layer type photosensitive layer, the amount of the charge-generating substance per 100 parts by mass of the binder resin is generally 0.1 part by mass or more, preferably 1 part by mass or more, and is generally 30 parts by mass or less, preferably 10 parts by mass or less.

With respect to each of the multilayer type photoreceptor and the single-layer type photoreceptor, known ingredients such as an antioxidant, plasticizer, ultraviolet absorber, electron-attracting compound, leveling agent, and visible-light-shielding agent may be incorporated into the photosensitive layer or into each of the layers constituting the photosensitive layer, for the purpose of improving film-forming properties, flexibility, applicability, nonfouling properties, gas resistance, light resistance, and other properties.

Other components of the photosensitive layer are explained next.

<Other Components>

The photosensitive layer may further contain various additives. These additives are used in order to improve film-forming properties, flexibility, mechanical properties, and other properties. Examples thereof include plasticizers, light absorbers for short-wavelength light such as ultraviolet rays, antioxidants, residual-potential control agents for controlling residual potential, dispersion aids for improving dispersion stability, leveling agents for improving applicability (e.g., silicone oils and fluorochemical oils), and surfactants. One additive may be used alone, or any desired two or more additives may be used in combination in any desired proportion.

<Film Thickness>

In the photoreceptor of the invention, the thickness of the photosensitive layer is not particularly limited, and the photosensitive layer may have any desired thickness unless this considerably lessens the effects of the invention. However, in the case of a single-layer type photoreceptor, the thickness of the photosensitive layer is generally 10 μm or larger, preferably 15 μm or larger, and is generally 50 μm or smaller, preferably 45 μm or smaller. In the case of a multilayer type photoreceptor, the charge-generating layer has a thickness of preferably 0.1-1 μm, more preferably 0.2-0.8 μm, and the charge-transporting layer has a thickness which is generally 5 μm or larger, preferably 10 μm or larger, and is generally 40 μm or smaller, preferably 35 μm or smaller. This charge-transporting layer may be composed of two or more different layers, besides being constituted of a single layer.

<Universal Hardness and Percentage Elastic Deformation>

From the standpoint of inhibiting noise generation due to friction with the cleaning blade or inhibiting the generation of surface scratches, it is preferred that the photosensitive layer should have a high surface hardness. From the standpoint of preventing toner removal failures, it is preferred that the photosensitive layer should have a high percentage elastic deformation. From the standpoint of inhibiting filming, it is preferred that both hardness and percentage elastic deformation should be high. Hardness and percentage elastic deformation depend on both the charge-transporting material and the binder resin and are affected also by compatibility therebetween. It is therefore necessary to design the photosensitive layer so that a combination of materials results in a hardness and a percentage elastic deformation within respective preferred ranges. With respect to the preferred surface hardness of the photosensitive layer, the lower limit thereof is generally 200 N/mm$^2$, preferably 215 N/mm$^2$, more preferably 230 N/mm$^2$, and the upper limit thereof is generally 290 N/mm$^2$, preferably 270 N/mm$^2$, in terms of universal hardness. A preferred range of the percentage elastic deformation of the photosensitive layer is as follows. The lower limit of the percentage elastic deformation thereof is generally 38% and is preferably 40%, more preferably 42% from the standpoint of preventing cleaning failures, and the upper limit thereof is generally 60%, preferably 55%.

Values of percentage elastic deformation and universal hardness in the invention are measured with microhardness meter FISCHERSCOPE H100C, manufactured by Fischer, in an environment having a temperature of 25° C. and a relative humidity of 50%. For the measurement, a Vickers pyramidal diamond indenter having an angle between the opposite faces of 136° is used. Measuring conditions are set as shown below, and the load imposed on the indenter and the indentation depth which results under the load are continuously read out. The load and the indentation depth are plotted as Y axis and X axis, respectively, to obtain a profile such as that shown in FIG. 4.

| Measuring Conditions | |
|---|---|
| Maximum indentation load | 5 mN |
| Time period for loading | 10 sec |
| Time period for unloading | 10 sec |

The percentage elastic deformation is a value defined by the following equation, and means the proportion of the quantity of work which is done by the elasticity of the film during unloading to the total quantity of work required for indentation.

$$\text{Percentage elastic deformation}(\%)=(We/Wt)\times 100$$

Figure 4:
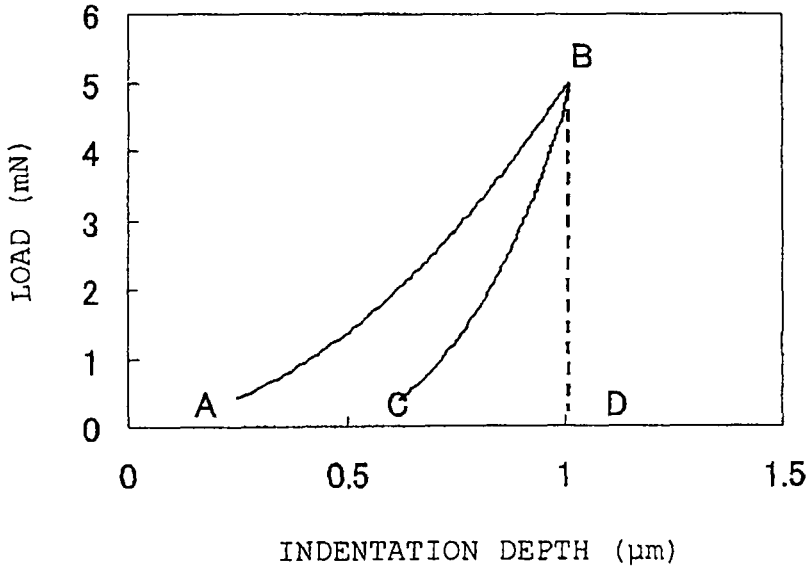
FIG. 4 is a graphic presentation showing an indentation depth-load curve.

In the equation, the total quantity of work Wt (nJ) means the area surrounded by A-B-D-A in FIG. 4, and the quantity of work done by elastic deformation We (nJ) means the area surrounded by C-B-D-C. The higher the percentage elastic deformation, the less the deformation caused by a load is apt to remain. In the case where the percentage elastic deformation is 100, this means that no deformation remains.

The universal hardness is a value determined from an indentation depth of the indenter indented to an indentation load of 5 mN, and is defined by the following equation.

Universal hardness ($N/mm^2$)=(test load ($N$))/(surface area ($mm^2$) of Vickers indenter under the test load)

[I-4. Other Layer]

A protective layer may be formed as an outermost layer on the photosensitive layer. This protective layer contains at least a charge-transporting material represented by general formula (1) and a binder resin represented by general formulae (2) and (3). Additives may be added to the protective layer so long as this addition impairs neither hardness nor percentage elastic deformation. Examples thereof include particles of resins such as a fluororesin, silicone resin, and crosslinked polystyrene resin and inorganic particles such as alumina particles and silica particles. In the case where the protective layer has a thickness larger than 1 μm, the mechanical properties of the surface are affected more by the material properties of the protective layer than by the underlying layer. In this case, any desired known materials may hence be used for the underlying photosensitive layer regardless of the ranges specified in the invention.

[I-5. Method for Forming Each Layer]

There are no limitations on methods for forming layers such as the undercoat layer, photosensitive layer, and protective layer. For example, use can be made of a method in which coating fluids each obtained by dissolving or dispersing the materials to be incorporated into the layer to be formed in a solvent are successively applied on a conductive substrate either directly or through another layer. After the application, the solvent is removed by drying. Thus, a photosensitive layer is formed.

Methods for the application are not limited, and any desired method can be used. For example, use can be made of dip coating, spray coating, nozzle coating, bar coating, roll coating, blade coating, or the like. Of these, dip coating is preferred from the standpoint of high productivity. Although one of these coating techniques may be used alone, two or more thereof may be used in combination.

[I-6. Electrification Type of the Photoreceptor]

The photoreceptor of the invention is for use in image formation in the image-forming apparatus which will be described later. The multilayer type photoreceptor of the invention is negatively charged when used, while the single-layer type photoreceptor is positively charged when used.

[I-7. Wavelength of Exposure Light for the Photoreceptor]

When the photoreceptor of the invention is used for image formation, the photoreceptor is exposed to writing light emitted from an exposure device and an electrostatic latent image is thereby formed. The writing light to be used here is not limited so long as an electrostatic latent image can be formed therewith. However, use may be made especially of monochromatic light having an exposure wavelength which is generally 380 nm or longer, especially 400 nm or longer, and is generally 850 nm or shorter. In particular, when monochromatic light having a wavelength of 480 nm or shorter is used, the photoreceptor can be exposed to light having a smaller spot size and high-quality images having high resolution and high gradation can be formed. It is therefore preferred to expose the photoreceptor to monochromatic light having a wavelength of 480 nm or shorter, when high-quality images are desired.

[II. Toner]

When image formation is conducted using the electrophotographic photoreceptor of the invention, any desired toner can be used as a developer for developing latent images. However, it is especially preferred to use a toner having a specific average degree of circularity (hereinafter suitably referred to as "toner of the invention") among various toners. Use of a toner having the specific degree of circularity enables the image-forming apparatus of the invention to form images of higher quality.

[II-1. Properties]

<Average Degree of Circularity>

The shape of the toner of the invention is as follows. The more the shapes of the individual particles constituting the toner are close to each other and to a sphere, the lower the possibility of charge localization within the individual toner particles and the higher the tendency that the toner shows even developing properties. Such a toner particle shape is hence preferred from the standpoint of enhancing image quality. In particular, when the toner has a shape close to a perfect sphere, this toner has a reduced area of contact with the electrophotographic photoreceptor and these are cases where the percentage toner transfer is increased and toner consumption can be reduced. Meanwhile, it is difficult to produce a tone having a perfectly spherical shape, and such a toner is highly costly. Consequently, the toner may be one which is close to a sphere so as to satisfy at least a certain requirement, and need not be perfectly spherical.

Specifically, the toner of the invention has an average degree of circularity, as determined with a flow type particle image analyzer, of generally 0.920 or higher, preferably 0.930 or higher, more preferably 0.960 or higher, especially preferably 0.980 or higher. The upper limit of the average degree of circularity thereof is generally 1.000 and is preferably 0.998, more preferably 0.995, from the standpoint of ease of production.

The average degree of circularity is used as a simple measure of quantitatively expressing the shapes of toner particles. In the invention, an examination is made with flow type particle image analyzer FPIA-2000, manufactured by Sysmex Corp., and the degree of circularity [a] of each particle examined is determined using the following equation (X).

$$\text{Degree of circularity } [a]=L0/L \quad (X)$$

(In equation (X), L0 represents the peripheral length of a circle having the same projected area as the particle image, and L represents the peripheral length of a particle image obtained by image processing.)

The degree of circularity is an index to the degree of surface irregularities of the tone particles. In the case of a toner which is perfectly spherical, the degree of circularity is 1.000. The more the surface shape is complicated, the lower the degree of circularity.

A specific method for determining the average degree of circularity is as follows. A surfactant (preferably, an alkylbenzenesulfonic acid salt) is added as a dispersant to 20 mL of water which is placed in a vessel and from which impurities have been removed beforehand. About 0.05 g of a test sample (toner) is further added. The sample is dispersed therein, and an ultrasonic wave is propagated to the resultant suspension for 30 seconds. The concentration of this dispersion is regulated to 3,000-8,000 particles/μL, and the flow type particle image analyzer is used to determine a circularity distribution for particles having an equivalent-circle diameter of 0.60 μm or larger but less than 160 μm.

There are no limitations on the volume-average particle diameter [Dv] of the toner of the invention, and the toner may have any desired volume-average particle diameter unless this considerably lessens the effects of the invention. However, the volume-average particle diameter thereof is generally 4 μm or larger, preferably 5 μm or larger, and is generally 10 μm or smaller, preferably 8 μm or smaller. In case where the volume-average particle diameter [Dv] of the toner is too small, there is a possibility that the stability of image quality might decrease. Too large volume-average particle diameters thereof may result in a decrease in resolution.

It is desirable that in the toner of the invention, the value [Dv/Dn] obtained by dividing the volume-average particle diameter [Dv] by the number-average particle diameter [Dn] should be generally 1.0 or larger and be generally 1.25 or smaller, preferably 1.20 or smaller, more preferably 1.15 or smaller. The value of [Dv/Dn] indicates the state of particle size distribution. The more the value thereof is close to 1.0, the narrower the particle size distribution. Narrower particle size distributions are desirable because such a toner has even electrification characteristics.

In the toner of the invention, the volume content of particles having a particle diameter of 25 μm or larger is generally 1% or less, preferably 0.5% or less, more preferably 0.1% or less, even more preferably 0.05% or less. The smaller the value thereof, the more the toner is preferred. This means that the proportion of coarse particles contained in the toner is small. Small proportions of coarse particles are preferred because such a toner is consumed in a reduced amount in continuous development and brings about stable image quality. Incidentally, although it is especially preferred that there should ideally be no coarse particles at all which have a particle diameter of 25 μm or larger, it is difficult to actually produce such a toner. Usually, the content of such coarse particles need not be reduced to 0.05% or less.

The volume content of particles having a particle diameter of 15 μm or larger in the toner of the invention is generally 2% or less, preferably 1% or less, more preferably 0.1% or less. With respect to coarse particles having a particle diameter of 15 μm or larger also, it is especially preferred that there should ideally be no such coarse particles. However, it is difficult to actually produce such a toner, and the content of such coarse particles usually need not be reduced to 0.1% or less.

It is desirable that the content by number of particles having a particle diameter of 5 μm or smaller in the toner of the invention should be generally 15% or less, preferably 10% or less, because this is effective in mitigating image fogging.

The volume-average particle diameter [Dv] and number-average particle diameter [Dn] of a toner, the volume content and content in number of particles in the toner, and other properties thereof can be determined in the following manners. COULTER COUNTER MULTISIZER TYPE II or TYPE III (manufactured by Beckman Coulter, Inc.) is used as an apparatus for toner particle diameter measurement, and an interface for outputting a number distribution or volume distribution and a general personal computer are connected thereto and used. Isoton II is used as an electrolytic solution. The method of measurement is as follows. To 100-150 mL of the electrolytic solution is added 0.1-5 mL of a surfactant (preferably, an alkylbenzenesulfonic acid salt) as a dispersant. Thereto is further added 2-20 mg of a test sample (toner). The electrolytic solution in which the sample is suspended is subjected to a dispersion treatment with an ultrasonic disperser for about 1-3 minutes, and the resultant dispersion is examined with COULTER COUNTER MULTISIZER TYPE II or TYPE III using an aperture of 100 μm. The number and volume of toner particles are thus determined to calculate a number distribution and a volume distribution respectively therefrom, and a volume-average particle diameter [Dv] and a number-average particle diameter [Dn] are determined respectively therefrom.

It is desirable that the THF-soluble components of the toner of the invention should give a gel permeation chromatography (hereinafter suitably referred to as "GPC") showing one or more peak molecular weights, at least one of which is generally 10,000 or higher, preferably 20,000 or higher, more preferably 30,000 or higher, and is generally 150,000 or lower, preferably 100,000 or lower, more preferably 70,000 or lower. In case where the peak molecular weight thereof is too low, there is a possibility that the toner might show impaired mechanical durability when used in the nonmagnetic one-component development mode. In case where the peak molecular weight thereof is too high, there is a possibility that low-temperature fixability and fixing strength are impaired.

The THF-insoluble content of the toner, as determined by the gravimetric method through CELITE filtration which will be described later, is generally 10% or higher, preferably 20% or higher, and is generally 60% or lower, preferably 50% or lower. In case where the THF-insoluble content is outside the range, there is a possibility that it might be difficult to attain both mechanical durability and low-temperature fixability.

Peak molecular weights of the toner of the invention may be determined under the following conditions using measuring apparatus HLC-8120GPC (manufactured by Tosoh Corp.).

In the heated chamber of 40° C., a column is stabilized, and THF is passed as a solvent through the column having that temperature, at a flow rate of 1 mL/min. Subsequently, the toner is dissolved in THF, and the solution is filtered through a 0.2-μm filter. This filtrate is used as a sample.

In the measurement, a resin solution in THF which has been regulated so as to have a sample concentration (resin concentration) of 0.05-0.6% by weight is injected into the measuring apparatus in an amount of 50-200 μL. In determining the molecular weights of the sample (resin components of the toner), a molecular weight distribution possessed by the sample is calculated from relationships between the logarithms of a calibration curve drawn with several monodisperse standard polystyrene samples and counts. As the standard polystyrene samples for drawing a calibration curve, use may be made, for example, of ones respectively having molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$ manufactured by Pressure Chemical Co. or Tosoh Corp. It is preferred to use at least about ten standard polystyrene samples. As a detector, an RI (refractive index) detector is used.

With respect to columns to be used in the measurement method, it is preferred to use a combination of a plurality of commercial polystyrene gel columns in order to accurately determine molecular weights in the range of $10^3$ to $2\times10^6$. For example, a combination of μ-STYRAGEL 500, 103, 104, and 105, manufactured by Waters Inc., or a combination of SHODEX KA801, 802, 803, 804, 805, 806, and 807, manufactured by Showa Denko K.K., is preferred.

The THF-insoluble content of a toner can be determined in the following manner. One gram of a sample (toner) is added to 100 g of THF, and this mixture is allowed to stand at 25° C. for 24 hours to dissolve soluble components. The resultant solution is filtered through 10 g of a CELITE, and the solvent is removed from the filtrate by distillation to determine the amount of THF solubles. This amount is subtracted from 1 g. Thus, the THF-insoluble content can be calculated.

<Softening Point and Glass Transition Temperature of Toner>

There are no limitations on the softening point [Sp] of the toner of the invention, and the toner may have any desired softening point unless this considerably lessens the effects of the invention. However, from the standpoints of high-temperature non-offset properties and durability, the softening point thereof is generally 80° C. or higher, preferably 100° C.

or higher. From the standpoint of fixing with low energy, the softening point thereof is generally 150° C. or lower, preferably 140° C. or lower.

The softening point [Sp] of a toner can be determined with a flow tester by a method in which 1.0 g of a sample is examined under the conditions of a nozzle of 1 mm×10 mm, a load of 30 kg, preheating of 5 minutes at 50° C., and a heating rate of 3° C./min. The temperature corresponding to the midpoint of the strand obtained through flow initiation to termination is taken as the softening point.

There are no limitations on the glass transition temperature [Tg] of the toner of the invention, and the toner may have any desired glass transition temperature unless this considerably lessens the effects of the invention. However, it is desirable that the glass transition temperature thereof should be 80° C. or lower, preferably 70° C. or lower, because such a toner can be fixed with low energy. From the standpoint of nonblocking properties, it is preferred that the glass transition temperature [Tg] thereof should be generally 40° C. or higher, preferably 50° C. or higher.

The glass transition temperature [Tg] of a toner can be determined with a differential scanning calorimeter by a method in which a curve is obtained through a measurement conducted under the conditions of a heating rate of 10° C./min and a tangent to each point where a transition (inflection) initiates is drawn. The temperature corresponding to the point where the two tangents meet each other is taken as the glass transition temperature.

Usually, the softening point [Sp] and glass transition temperature [Tg] of a toner are considerably affected by the kinds of the polymers contained in the toner and by the proportions of the polymers. Consequently, the softening point [Sp] and glass transition temperature [Tg] of a toner can be regulated by suitably optimizing the kinds and composition of the polymers which will be described later. It is also possible to regulate the softening point [Sp] and glass transition temperature [Tg] of a toner by regulating, for example, the molecular weight and gel content of each polymer and the kinds and amounts of low-melting ingredients, e.g., a wax, to be incorporated.

<Wax in the Toner>

In the case where the toner of the invention contains a wax, the dispersed-particle diameter of the wax in the toner particles is generally 0.1 μm or larger, preferably 0.3 μm or larger, in terms of average particle diameter. The upper limit thereof is generally 3 μm, preferably 1 μm. In case where the dispersed-particle diameter thereof is too small, there is a possibility that the effect of improving the non-filming properties of the toner might not be obtained. In case where the dispersed-particle diameter thereof is too large, the wax is apt to be exposed on the toner surface and there is hence a possibility that electrification characteristics and heat resistance might be low.

The dispersed-particle diameter of a wax can be ascertained by a method in which toner particles are sliced and then examined with an electron microscope, or by other methods, for example, a method which includes dissolving away the polymers of the toner using, for example, an organic solvent in which the wax is insoluble, filtering the resultant mixture through a filter, and examining wax particles remaining on the filter with a microscope.

The proportion of the wax in the toner is not limited unless the effects of the invention are considerably lessened. However, the proportion thereof is generally 0.05% by weight or more, preferably 0.1% by weight or more, and is generally 20% by weight or less, preferably 15% by weight or less. In case where the proportion of the wax is too small, there is a possibility that the range of fixing temperatures might be insufficient. In case where the proportion thereof is too large, there is a possibility that apparatus members might be fouled, resulting in a decrease in image quality.

[II-2. Processes for Production]

There are no particular limitations on the toner of the invention so long as the toner has the average degree of circularity described above. With respect to kinds of toner, various toners are usually obtained according to the production processes. Any of such toners can be used as the toner of the invention.

Some examples of toner production processes are explained below, but processes for producing the toner of the invention should not be construed as being limited to the following processes.

The toner of the invention may be produced by any known method. Examples thereof include toners produced by the polymerization method and the melt suspension method. Also usable is a toner obtained by rounding a pulverization toner by a treatment with, for example, heat. However, a toner produced by the so-called polymerization method, in which toner particles are yielded in an aqueous medium (polymerization-method toner), is preferred.

Examples of processes which can be used for producing a toner by the polymerization method include: a method in which a toner is directly yielded using the suspension polymerization method described in, for example, JP-B-36-10231, JP-A-59-53856, or JP-A-59-61842; a dispersion polymerization method in which a water-miscible organic solvent in which monomers are soluble but the polymer to be obtained is insoluble is used to directly yield a toner; and an emulsion polymerization method represented by a soap-free polymerization method in which polymerization is conducted in the presence of a water-soluble polar polymerization initiator to directly yield a toner through polymerization.

Examples of the polymerization-method toner include toners produced by a suspension polymerization method and toners produced by an emulsion polymerization aggregation method.

Techniques have been proposed in which a substance having a low softening point (wax) is incorporated into a toner in order to improve the releasability, low-temperature fixability, high-temperature non-offset properties, non-filming properties, and other properties of the toner. In a melt kneading pulverization method, it is difficult to incorporate a wax in a larger amount into the toner, and about 5% by weight based on the polymer (binder resin) is regarded as a limit. In contrast, in polymerization-method toners, a substance having a low softening point can be incorporated in a large amount (specifically, generally 5-30% by weight). Incidentally, the term "polymer" as used here means one of the materials constituting the toner. For example, in the case of a toner produced by the emulsion polymerization aggregation method which will be described later, that term means a product of polymerization of one or more polymerizable monomers.

Examples of methods for relatively easily obtaining fine toner particles which have a particle diameter of 3-8 μm and a narrow particle size distribution and which can have an average degree of circularity controlled so as to be 0.960 or higher include a suspension polymerization method and an emulsion polymerization aggregation method which are conducted at ordinary pressure (usually 1 atm) or at an elevated pressure.

In the case where the toner of the invention is produced using a suspension polymerization method, a specific method for incorporating a substance having a low softening point into inner parts of toner particles is as follows. The polarity in an aqueous medium of a substance having a low softening point is set so as to be lower than that of the main monomer, and a highly polar resin or monomer is further mixed therewith in a small amount. Thus, a toner having the so-called core/shell structure in which the substance having a low softening point is coated with a shell resin can be obtained. With respect to control of the particle size distribution of a toner and control of the particle diameter thereof, the given toner of the invention can be obtained, for example, by a method in which the kinds and addition amounts of a poorly water-soluble inorganic salt and a dispersant functioning as a protective colloid are changed, or by controlling mechanical apparatus conditions (e.g., stirring conditions such as the peripheral speed of the rotor, number of passes, and shape of the stirring blades), the shape of the vessel, the solid concentration in the aqueous solution, etc.

As the shell resin of the toner of the invention, use can be made of resins in general use, such as styrene/(meth)acrylic copolymers, polyester resins, epoxy resins, and styrene/butadiene copolymers. In the methods in which a toner is directly obtained by the polymerization method, it is preferred to use monomers for any of these resins. One of those resins may be used alone as the shell resin, or any desired combination of two or more of those resins may be used in any desired proportion.

Colorants suitable for use in the invention are as follows. As black colorants, use may be made, for example, of carbon blacks, magnetic substances, substances which have been colored black using the yellow, magenta, and cyan colorants shown below, and the like. As the yellow colorants, use may be made, for example, of compounds represented by condensation azo compounds, isoindolinone compounds, anthraquinone compounds, azo metal complexes, methine compounds, and allylamide compounds. Specifically, C.I Pigment Yellow 12, 13, 14, 15, 17, 62, 74, 83, 93, 94, 95, 109, 110, 111, 128, 129, 147, and 168 are suitable. One of such colorants may be used alone, or any desired combination of two or more thereof may be used in any desired proportion.

As the magenta colorants, use may be made, for example, of condensation azo compounds, diketopyrrolopyrrole compounds, anthraquinone, quinacridone compounds, basic-dye lake compounds, naphthol compounds, benzimidazolone compounds, thioindigo compounds, perylene compounds, and the like. Specifically, C.I. Pigment Red 2, 3, 5, 6, 7, 23, 48:2, 48:3, 48:4, 57:1, 81:1, 144, 146, 166, 169, 177, 184, 185, 202, 206, 220, 221, and 254 are especially preferred.

As the cyan colorants for the invention, use can be made, for example, of copper phthalocyanine compounds and derivatives thereof, anthraquinone compounds, basic-dye lake compounds, and the like. Specifically, C.I. Pigment Blue 1, 7, 15, 15:1, 15:2, 15:3, 15:4, 60, 62, 66, and the like are suitable. These colorants can be used alone or a mixture of two or more thereof, or may be used in a solid-solution state.

Suitable colorants to be used in the invention, in the case of a color toner, may be selected while taking account of hue angle, chroma, lightness, weatherability, OHP transparency, and dispersibility in the toner. It is desirable that the amount of the colorants to be incorporated should be generally 1-20 parts by weight per 100 parts by weight of the resin.

In the case where a magnetic substance is used as a black colorant, it is desirable that the amount of the magnetic substance should be generally 40-150 parts by weight per 100 parts by weight of the resin, unlike that of other colorants.

Known charge control agents can be used in the invention. In the case of a color toner, however, it is especially preferred to use a charge control agent which is colorless, enables the toner to be rapidly charged, and can stably maintain a certain charge amount. In the case where a direct polymerization method is used in the invention, a charge control agent which does not inhibit the polymerization and from which no components dissolve in the aqueous system is especially preferred.

Specific examples of usable compounds for negative electrification include salicylic acid, naphthoic acid, metal compounds of dicarboxylic acids, sulfonic acids, polymeric compounds having carboxylic acids in side chains, boron compounds, urea compounds, silicon compounds, and calixarenes. Preferred examples of compounds for positive electrification include quaternary ammonium salts, polymeric compounds having the quaternary ammonium salts in side chains, guanidine compounds, and imidazole compounds. It is desirable that the amount of such a charge control agent should be generally 0.5-10 parts by weight per 100 parts by weight of the resin.

In the case where a direct polymerization method is used in the invention, the following polymerization initiators may be used. Examples of azo polymerization initiators include 2,2'-azobis(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile. Examples of peroxide type polymerization initiators include benzoyl peroxide, methyl ethyl ketone peroxide, diisopropyl peroxycarbonate, cumene hydroperoxide, 2,4-dichlorobenzoyl peroxide, and lauryl peroxide. One of such polymerization initiators may be used alone, or any desired combination of two or more thereof may be used in any desired proportion.

The amount of the polymerization initiator to be incorporated varies depending on the desired degree of polymerization. However, the polymerization initiator may be used in an amount of generally 0.5-20% by weight based on the monomers. The kind of polymerization initiator slightly varies depending on polymerization methods. However, a single polymerization initiator or a mixture of two or more polymerization initiators is used while taking account of the 10-hour half-life temperatures thereof. It is possible to further incorporate a known crosslinking agent, chain transfer agent, polymerization inhibitor, and the like in order to control the degree of polymerization.

In the case where suspension polymerization is used as a process for producing the toner of the invention, the following compounds may be used as dispersants. Examples of inorganic compounds include tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, alumina, magnetic substances, and ferrite. Examples of organic compounds include poly(vinyl alcohol), gelatin, methyl cellulose, methyl hydroxypropyl cellulose, ethyl cellulose, the sodium salt of carboxymethyl cellulose, and starch; these organic compounds are used as a dispersion in the aqueous phase. One of such dispersants may be used alone, or any desired combination of two or more thereof may be used in any desired proportion.

It is preferred that these dispersants should be used in an amount of generally 0.2-10.0 parts by weight per 100 parts by weight of the polymerizable monomers. A commercial product of any of those dispersants may be used as it is. However, it is possible to yield an inorganic compound in a dispersion medium with high-speed agitation in order to obtain finely dispersed particles having an even particle size. In the case of tricalcium phosphate, for example, an aqueous sodium phosphate solution is mixed with an aqueous calcium chloride solution with high-speed agitation, and a preferred dispersant for the suspension polymerization method can be thereby obtained.

In order to finely disperse those dispersants, a surfactant may be used in combination therewith in an amount of generally 0.001-0.1 part by weight. Specifically, commercial nonionic, anionic, and cationic surfactants can be used. For example, it is preferred to use sodium dodecyl sulfate, sodium tetradecyl sulfate, sodium pentadecyl sulfate, sodium octyl sulfate, sodium oleate, sodium laurate, potassium stearate, calcium oleate, or the like. With respect to such surfactants also, one of these may be used alone, or any desired combination of two or more thereof may be used in any desired proportion.

In the case where a direct polymerization method is used as a process for producing the toner of the invention, the toner can be produced, for example, in the following manner.

A release agent which is a substance having a low softening point, a colorant, a charge control agent, a polymerization initiator, and other additives are added to monomers and evenly dissolved or dispersed therein with a homogenizer, ultrasonic disperser, or the like. The resultant monomer composition is dispersed in an aqueous phase containing a dispersion stabilizer, by means of an ordinary stirrer or of a homomixer, homogenizer, or the like. In this operation, it is preferred to disperse the monomer composition into droplets having a desired toner particle size by regulating stirring rate, stirring period, etc. Thereafter, it is sufficient to conduct stirring at such a rate that the particle state is maintained and particle sedimentation is prevented by the action of the dispersion stabilizer.

For conducting the polymerization, the polymerization temperature is set generally at 40° C. or higher, preferably at 50° C.-90° C. The latter half of the polymerization reaction may be conducted at a higher temperature. For the purpose of improving durability, the aqueous medium may be partly distilled off during the latter half of the reaction or after completion of the reaction in order to remove unreacted polymerizable monomers, by-products, etc. After completion of the reaction, the toner particles yielded are washed, recovered by filtration, and dried. In the suspension polymerization method, it is preferred to use water as a dispersion medium in an amount of generally 300-3,000 parts by weight per 100 parts by weight of the monomers.

The toner particles to be used in the invention may be classified to regulate the particle size distribution thereof. In a preferred method therefor, a classifier for classifying into multiple fractions based on inertia force is used. By using this device, a toner having a desired particle size distribution can be efficiently produced.

In the case where a tone is produced by an emulsion polymerization aggregation method, the production steps generally include a polymerization step, a mixing step, an aggregation step, a fusion step, and a washing/drying step. Namely, the procedure is generally as follows. Primary polymer particles are obtained by emulsion polymerization (polymerization step), and dispersions of a colorant (pigment), wax, charge control agent, and other ingredients are mixed according to need with the dispersion containing the primary polymer particles (mixing step). A coagulant is added to the dispersion to aggregate the primary particles and thereby form particle aggregates (aggregation step). An operation for adhering fine particles or the like is conducted according to need, before the particles constituting each aggregate are fused together to obtain particles (fusion step). The particles obtained are washed and dried (washing/drying step), thereby obtaining base particles.

[III. Image-Forming Apparatus]

An embodiment of the image-forming apparatus (image-forming apparatus of the invention) employing the electrophotographic photoreceptor of the invention is explained below by reference to FIG. 1, which illustrates the configuration of important parts of the apparatus. However, the image-forming apparatus of the invention should not be construed as being limited to the following explanation, and can be modified at will unless the modifications depart from the spirit of the invention.

As shown in FIG. 1, the image-forming apparatus includes an electrophotographic photoreceptor 1, a charging unit (device) 2, an exposure unit (device) (imagewise-exposure device) 3, and a developing unit (device) 4. The apparatus is further provided according to need with a transfer unit (device) 5, a cleaning unit 6, and a fixing unit (device) 7.

The electrophotographic photoreceptor 1 is not particularly limited so long as it is the electrophotographic photoreceptor of the invention described above. FIG. 1 shows, as an example thereof, a drum-shaped photoreceptor constituted of a cylindrical conductive substrate and, formed on the surface thereof, the photosensitive layer described above. The charging device 2, exposure device 3, developing device 4, transfer device 5, and cleaning unit 6 have been disposed along the peripheral surface of this electrophotographic photoreceptor 1.

The charging device 2 serves to positively charge the electrophotographic photoreceptor 1, and evenly charges the surface of the electrophotographic photoreceptor 1 to a given potential. FIG. 1 shows a roller type charging device (charging roller) as an example of the charging device 2. However, corona charging devices such as corotrons and scorotrons, contact type charging devices such as charging brushes, and the like are frequently used besides the charging rollers.

In many cases, the electrophotographic photoreceptor 1, charging device 2, and cleaning unit 6 have been designed to constitute a cartridge (electrophotographic photoreceptor cartridge of the invention; hereinafter suitably referred to as "photoreceptor cartridge") so that the cartridge can be removed from the main body of the image-forming apparatus and replaced. For example, in this configuration, when the electrophotographic photoreceptor 1, the charging device 2, and the cleaning unit 6 have deteriorated, this photoreceptor cartridge can be removed from the main body of the image-forming apparatus and a fresh photoreceptor cartridge can be mounted in the main body of the image-forming apparatus. Also with respect to the toner, which will be described later, the toner in many cases has been designed to be stored in a toner cartridge and be removable from the main body of the image-forming apparatus. According to this configuration, when the toner in the toner cartridge in use has run out, this toner cartridge can be removed from the main body of the image-forming apparatus and a fresh toner cartridge can be mounted. Furthermore, there are cases where a cartridge including all of an electrophotographic photoreceptor 1, a charging device 2, a cleaning unit 6, and a toner is used.

The exposure device 3 is not particularly limited in kind so long as it can expose (imagewise expose) the electrophotographic photoreceptor 1 to light and thereby form an electrostatic latent image in the photosensitive surface of the electrophotographic photoreceptor 1. Examples thereof include halogen lamps, fluorescent lamps, lasers such as semiconductor lasers and He—Ne lasers, and LEDs (light-emitting diodes). It is also possible to conduct exposure by the technique of internal photoreceptor exposure. Although any desired light can be used for exposure, monochromatic light is generally preferred. For example, monochromatic light having a wavelength (exposure wavelength) of 700-850 nm, monochromatic light having a slightly shorter wavelength of 600-700 nm, monochromatic light having a short wavelength of 300-500 nm, or the like may be used to conduct exposure.

The developing device 4 is not particularly limited in kind so long as it can develop the electrostatic latent image formed on the exposed electrophotographic photoreceptor 1 to form a visible image. For example, any desired device can be used, such as one operated by a dry development technique, e.g., cascade development, development with one-component conductive toner, or two-component magnetic brush development, a wet development technique, etc. The developing device 4 shown in FIG. 1 includes a developing vessel 41, agitators 42, a feed roller 43, a developing roller 44, and a control member 45. This developing device 4 has such a configuration that a toner T is stored in the developing vessel 41. According to need, the developing device 4 may be equipped with a replenishing device (not shown) for replenishing the toner T. This replenishing device has such a configuration that the toner T can be supplied from a container such as a bottle or cartridge.

The feed roller 43 is made of a conductive sponge or the like. The developing roller 44 is constituted of, for example, a metallic roll made of iron, stainless steel, aluminum, nickel, or the like or a resinous roll obtained by coating such a metallic roll with a silicone resin, urethane resin, fluororesin, or the like. The surface of this developing roller 44 may be subjected to surface-smoothing processing or surface-roughening processing according to need.

The developing roller 44 is disposed between the electrophotographic photoreceptor 1 and the feed roller 43, and is in contact with each of the electrophotographic photoreceptor 1 and the feed roller 43. However, the developing roller 44 and the electrophotographic photoreceptor 1 may be disposed close to each other without being in contact with each other. The feed roller 43 and the developing roller 44 are rotated by a rotation driving mechanism (not shown). The feed roller 43 holds the toner T stored and supplies it to the developing roller 44. The developing roller 44 holds the toner T supplied by the feed roller 43 and brings it into contact with the surface of the electrophotographic photoreceptor 1.

The control member 45 is constituted of a resinous blade made of a silicone resin, urethane resin, or the like, a metallic blade made of stainless steel, aluminum, copper, brass, phosphor bronze, or the like, a blade obtained by coating such a metallic blade with a resin, etc. This control member 45 is usually in contact with the developing roller 44 and is pushed against the developing roller 44 with a spring or the like at a given force (the linear blade pressure is generally 0.05-5 N/cm). According to need, this control member 45 may have the function of charging the toner T based on electrification by friction with the Toner T.

The agitators 42, which are disposed according to need, are rotated by the rotation driving mechanism. They agitate the toner T and convey the toner T to the feed roller 43 side. Two or more agitators 42 differing in blade shape, size, etc. may be disposed.

The transfer device 5 is not particularly limited in kind, and use can be made of a device operated by any desired technique selected from an electrostatic transfer technique, pressure transfer technique, adhesive transfer technique, and the like, such as corona transfer, roller transfer, and belt transfer. Here, the transfer device 5 is one constituted of a transfer charger, transfer roller, transfer belt, or the like disposed so as to face the electrophotographic photoreceptor 1. A given voltage (transfer voltage) which has the polarity opposite to that of the charge potential of the toner T is applied to the transfer device 5, and this transfer device 5 thus transfers the toner image formed on the electrophotographic photoreceptor 1 to recording paper (paper, medium, or receiving object) P.

The cleaning unit 6 serves to scrape off the residual toner adherent to the photoreceptor 1 with a cleaning blade and to hold the toner in a recovery vessel, i.e., recover the residual toner. The cleaning blade is constituted of an elastic rubber member and a supporting member, and may further include, according to need, an edge member disposed at the part of the elastic rubber member which is in contact with the photoreceptor. For these cleaning blade members, polyurethanes are generally used. This is because polyurethanes have satisfactory wear resistance although elastic, have sufficient mechanical strength without necessitating addition of a reinforcement thereto, and are not pollutive. It is, however, known that the properties of polyurethanes have a dependence on temperature. Impact resilience is especially temperature-dependent, and this is problematic for cleaning. Namely, a decrease in impact resilience which occurs at low temperatures results in cleaning failures, while an increase in impact resilience which occurs at high temperatures result in troubles such as edge chipping or chattering. It is therefore desired to obtain a highly functional cleaning blade which has sufficiently stable impact resilience even when environmental changes occur. In particular, since appliances are apt to have higher internal temperatures as a result of the recent trend toward size reduction therein, there is a growing desire for a decrease in such temperature dependences of impact resilience. It is preferred, from the standpoint of enhancing cleaning efficiency, that the elastic rubber member or edge member should be made of a polyurethane produced from a polyester polyol obtained by reacting adipic acid with a diol ingredient or from a caprolactone-based polyester polyol, so as to be a polyurethane having the desirable impact resilience. Preferred properties of such polyurethanes include a 100% permanent elongation of 3% or less, an impact resilience at 25° C. of 20% or less, and a difference between the maximum and minimum values of impact resilience in 10-50° C. range of 30% or less.

From the standpoint of improving cleaning properties, it is preferred that the cleaning blade should be in counter contact with the photoreceptor.

The fixing device 7 is constituted of an upper fixing member (fixing roller) 71 and a lower fixing member (fixing roller) 72, and the fixing member 71 or 72 is equipped with a heater 73 inside. FIG. 1 shows an example in which the upper fixing member 71 is equipped with a heater 73 inside. As the upper and lower fixing members 71 and 72, use can be made of a known heat-fixing member such as a fixing roll obtained by coating a metallic tube made of stainless steel, aluminum, or the like with a silicone rubber, a fixing roll obtained by further coating that fixing roll with a Teflon (registered trademark), or a fixing sheet. Furthermore, the fixing members 71 and 72 each may have a configuration in which a release agent such as a silicone oil is supplied thereto in order to improve release properties, or may have a configuration in which the two members are forcedly pressed against each other with a spring or the like.

The toner which has transferred to the recording paper P passes through the nip between the upper fixing member 71 heated at a given temperature and the lower fixing member 72, during which the toner is heated to a molten state. After the passing, the toner is cooled and fixed to the recording paper P.

The fixing device also is not particularly limited in kind. Fixing devices which can be mounted include ones operated by any desired fixing technique, such as heated-roller fixing, flash fixing, oven fixing, or pressure fixing, besides the device used here.

In the electrophotographic apparatus having the configuration described above, an image is recorded through a charging step in which the photoreceptor is charged, an exposure step in which the charged photoreceptor is exposed to form an electrostatic latent image, a development step in which the electrostatic latent image is developed with a toner, and a transfer step in which the toner is transferred to a receiving object. Namely, the surface (photosensitive surface) of the photoreceptor 1 is first charged to a given potential by the charging device 2 (charging step). This charging may be conducted with a direct-current voltage or with a direct-current voltage on which an alternating-current voltage has been superimposed.

Subsequently, the photoreceptor is exposed to light to form an electrostatic latent image (exposure step). Namely, the photosensitive surface of the charged photoreceptor 1 is exposed by the exposure device 3 according to the image to be recorded. Thus, an electrostatic latent image is formed in the photosensitive surface.

The electrostatic latent image formed in the photosensitive surface of the photoreceptor 1 is developed by the developing device 4 (development step). In the developing device 4, the toner T fed by the feed roller 43 is formed into a thin layer with the control member (developing blade) 45 and, simultaneously therewith, frictionally charged so as to have given polarity (here, the toner is charged so as to have positive polarity, which is the same as the polarity of the charge potential of the photoreceptor 1). This toner T is conveyed while being held by the developing roller 44 and is brought into contact with the surface of the photoreceptor 1. When the charged toner T held on the developing roller 44 comes into contact with the surface of the photoreceptor 1, a toner image corresponding to the electrostatic latent image is formed on the photosensitive surface of the photoreceptor 1.

This toner image is transferred to recording paper P by the transfer device 5 (transfer step). Thereafter, the toner which has not been transferred and remains on the photosensitive surface of the photoreceptor 1 is removed by the cleaning unit 6.

After the transfer of the toner image to the recording paper P, this recording paper P is passed through the fixing device 7 to thermally fix the toner image to the recording paper P. Thus, a finished image is obtained.

Incidentally, the image-forming apparatus may have a configuration in which, for example, an erase step can be conducted, in addition to the configuration described above. The erase step is a step in which the electrophotographic photoreceptor is illuminated to thereby erase the residual charges from the electrophotographic photoreceptor. As an eraser, use may be made of a fluorescent lamp, LED, or the like. The light to be used in the erase step, in many cases, has such an intensity that the exposure energy thereof is at least 3 times the energy of the exposure light.

The configuration of the image-forming apparatus may be further modified. For example, the apparatus may have a configuration in which a pre-exposure step, an auxiliary charging step, or the like can be conducted, or may have a configuration in which offset printing is conducted. Furthermore, the apparatus may have a full-color tandem configuration employing a plurality of toners.

EXAMPLES

Embodiments of the invention will be explained below in more detail by reference to Examples. However, the following Examples are given merely for explaining the invention in detail, and the invention should not be construed as being limited to the following Examples and can be modified at will unless the modifications depart from the spirit of the invention. In the following Examples and Comparative Examples, the expression "parts" means "parts by weight" unless otherwise indicated. Incidentally, the polycarbonate resins used in Examples 1 to 6, Comparative Example 2, and Comparative Examples 5 to 10 are resins sold by Bayer AG under the trade name APEC, and were used as such without further purifying the resins.

Example 1

Production of Coating Fluids

A coating fluid for undercoat layer formation was produced in the following manner. Rutile titanium oxide having an average primary-particle diameter of 40 nm ("TTO55N", manufactured by Ishihara Sangyo Kaisha, Ltd.) was mixed with methyldimethoxysilane ("TSL8117", manufactured by Toshiba Silicone Co., Ltd.), the amount of which was 3% by weight based on the titanium oxide, by means of a HENSCHEL mixer. The resultant surface-treated titanium oxide was dispersed in a mixed solvent composed of methanol and 1-propanol in a weight ratio of 7/3 by means of a ball mill to obtain a dispersion slurry of the surface-treated titanium oxide. The dispersion slurry was mixed with a methanol/1-propanol/toluene mixed solvent and pellets of a copolyamide composed of c-caprolactam [compound represented by the following formula (A)], bis(4-amino-3-methylcyclohexyl) methane [compound represented by the following formula (B)], hexamethylenediamine [compound represented by the following formula (C)], decamethylenedicarboxylic acid [compound represented by the following formula (D)], and octadecamethylenedicarboxylic acid [compound represented by the following formula (E)] in a molar ratio of 60%/15%/5%/15%/5%, with heating and stirring to dissolve the polyamide pellets. The resultant solution was subjected to an ultrasonic dispersion treatment to thereby produce a coating fluid for undercoat layer formation in which the methanol/1-propanol/toluene ratio was 7/1/2 by weight and which contained the surface-treated titanium oxide and the copolyamide in a weight ratio of 3/1 and had a solid concentration of 18.0%.

A

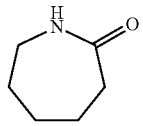

B

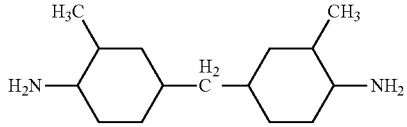

C

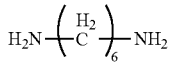

D

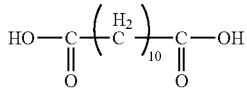

-continued

E

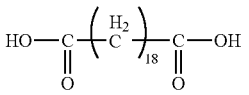

A coating fluid for charge-generating layer formation was produced in the following manner.

Figure 2:
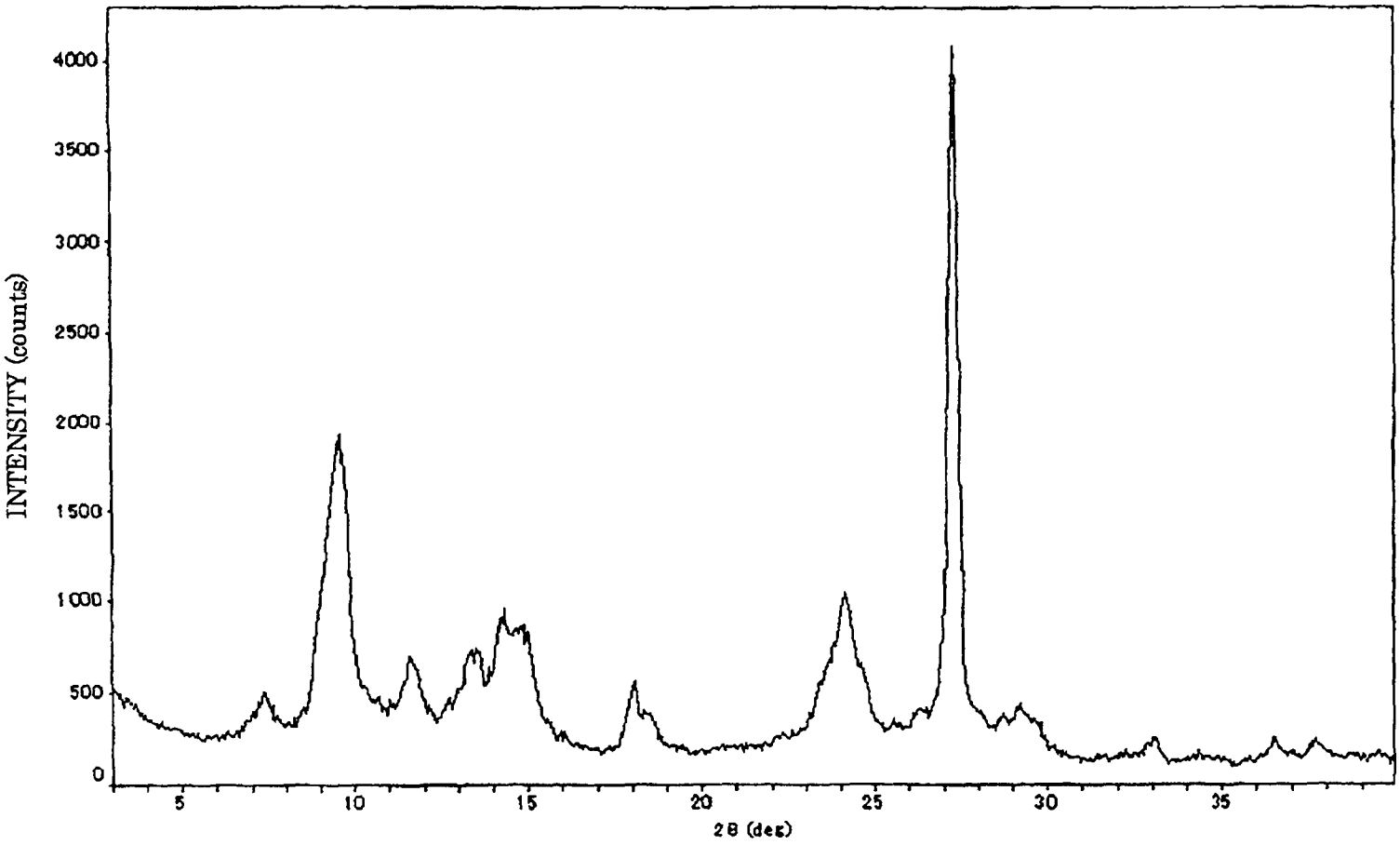
FIG. 2 is an X-ray diffraction pattern showing an X-ray powder diffraction spectrum of an oxytitanium phthalocyanine used in the Examples according to the invention and in the Comparative Examples.

First, 20 parts of oxytitanium phthalocyanine giving the X-ray diffraction spectrum shown in FIG. 2 in an examination with CuKα characteristic X rays was mixed, as a charge-generating substance, with 280 parts of 1,2-dimethoxyethane. This mixture was subjected to a pulverization/dispersion treatment in which the mixture was treated for 1 hour with a sand grinding mill. Subsequently, the liquid obtained by this pulverization treatment was mixed with a binder solution obtained by dissolving 10 parts of poly(vinyl butyral) (trade name "DENKA BUTYRAL" #6000C, manufactured by Denki Kagaku Kogyo K.K.) in a mixed liquid composed of 255 parts of 1,2-dimethoxyethane and 85 parts of 4-methoxy-4-methyl-2-pentanone and further with 230 parts of 1,2-dimethoxyethane. Thus, a coating fluid for charge-generating layer formation A was prepared.

Figure 3:
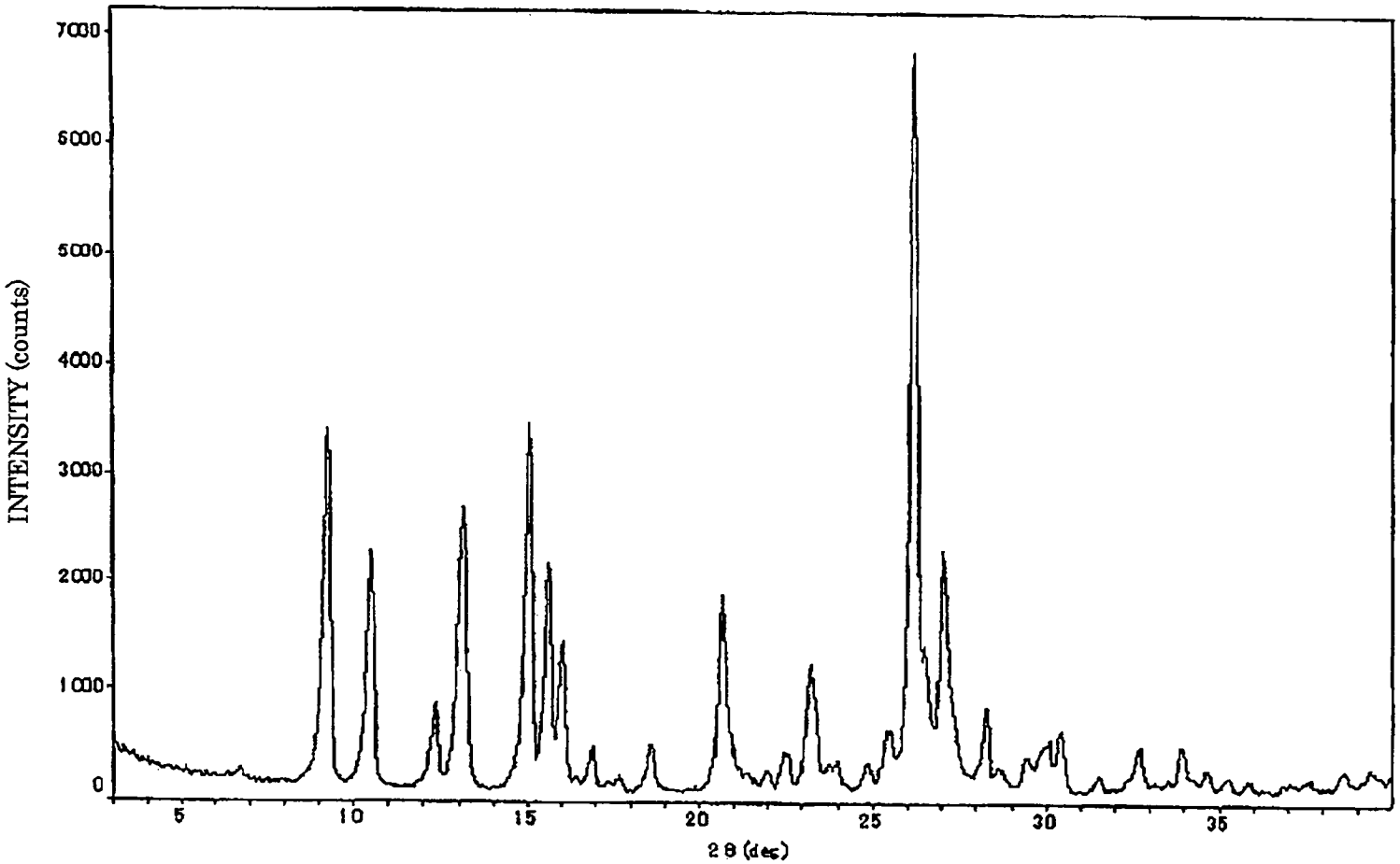
FIG. 3 is an X-ray diffraction pattern showing an X-ray powder diffraction spectrum of another oxytitanium phthalocyanine used in the Examples according to the invention and in the Comparative Examples.

Next, 20 parts of oxytitanium phthalocyanine giving the X-ray diffraction spectrum shown in FIG. 3 in an examination with CuKα characteristic X rays was mixed, as a charge-generating substance, with 280 parts of 1,2-dimethoxyethane. This mixture was subjected to a pulverization/dispersion treatment in which the mixture was treated for 4 hours with a sand grinding mill. Subsequently, the liquid obtained by this pulverization treatment was mixed with a binder solution obtained by dissolving 10 parts of poly(vinyl butyral) (trade name "DENKA BUTYRAL" #6000C, manufactured by Denki Kagaku Kogyo K.K.) in a mixed liquid composed of 255 parts of 1,2-dimethoxyethane and 85 parts of 4-methoxy-4-methyl-2-pentanone and further with 230 parts of 1,2-dimethoxyethane. Thus, a coating fluid for charge-generating layer formation B was prepared.

Subsequently, the coating fluid for charge-generating layer formation A was mixed with the coating fluid for charge-generating layer formation B in a weight ratio of 8:2 to produce a coating fluid for charge-generating layer formation to be used in this Example.

A coating fluid for charge-transporting layer formation was produced in the following manner.

A hundred parts of a polycarbonate resin having the following repeating structure (m:n=67:33; weight-average molecular weight (Mw), 55,000; number-average molecular weight (Mn), 22,000), 80 parts of the compound represented by (1)-2 shown above as a charge-transporting material, 8 parts of trade name IRGANOX 1076, manufactured by Ciba Specialty Chemicals Co., as an antioxidant, and 0.05 parts of a silicone oil (trade name KF96, manufactured by Shin-Etsu Silicone) as a leveling agent were dissolved in 520 parts of a THF/toluene (8/2 (by weight)) mixed solvent. Thus, a coating fluid for charge-transporting layer formation was prepared.

<Production of Photoreceptor>

The coating fluid for undercoat layer formation, the coating fluid for charge-generating layer formation, and the coating fluid for charge-transporting layer formation were successively applied by dip coating to an aluminum cylinder and dried, the aluminum cylinder having an outer diameter of 30 mm, a length of 260.5 mm, and a wall thickness of 0.75 mm and having a mirror-polished and cleaned surface. An undercoat layer, a charge-generating layer, and a charge-transporting layer were thus formed so that these layers had thicknesses of 1.3 μm, 0.4 μm, and 25 μm, respectively, after drying, thereby obtaining a photoreceptor drum. The drying for forming the charge-transporting layer was conducted at 125° C. for 20 minutes.

<Electrical Property Test>

An apparatus for evaluating electrophotographic properties produced in accordance with the measurement standards of the Society of Electrophotography of Japan (described in *Zoku Denshi Shashin Gijutsu No Kiso To Ōyō*, the Society of Electrophotography of Japan, ed., Corona Publishing Co., Ltd., pp. 404-405) was used to charge the photoreceptor so as to result in an initial surface potential of −700 V, while rotating the photoreceptor at 80 rpm. Monochromatic light of 780 nm obtained by passing light from a halogen lamp through an interference filter was used together with ND filters differing in transmittance to examine the surface potential attenuation behavior while changing the quantity of light. In this examination, after exposure at each quantity of light, the photoreceptor was illuminated with 660-nm LED light as erase light to erase most of the residual charges. Determined were values of the exposure amount required for the surface potential to be halved (half-decay exposure; referred to as $E_{1/2}$) and the surface potential of the photoreceptor exposed to the 780-nm monochromatic light in an amount of 1.7 μJ/cm$^2$ (light potential; referred to as VL). The results thereof are shown in Table 1.

<Evaluation of Surface Properties of the Photoreceptor>

The percentage elastic deformation and the universal hardness were measured with microhardness meter FISCHERSCOPE H100C, manufactured by Fischer, in an environment having a temperature of 25° C. and a relative humidity of 50%. The results obtained are shown in Table 1.

<Image Test>

Subsequently, the photoreceptor drum produced above and a toner T1 having an average particle diameter of 6.0 μm and an average degree of circularity of 0.990 were used and mounted on a commercial apparatus to conduct an image quality test.

The image quality test was performed using color printer HP COLOR LASERJET 4700 dn (cleaning blade; counter contact type), manufactured by Hewlet-Packard Co. As the cleaning blade, use was made of a material having an impact resilience of 18% which was a urethane produced from a polyester polyol obtained by reacting adipic acid with a diol ingredient as main ingredients.

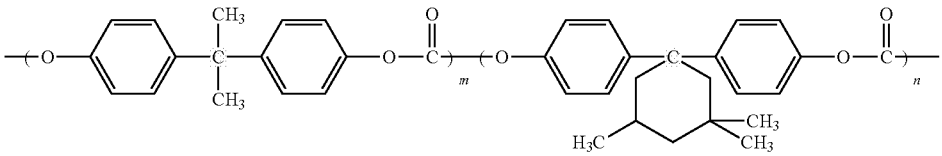

The photoreceptor drum produced and the toner T1 were mounted in a process cartridge for cyan, and this cartridge was mounted on the printer. Image formation on 10,000 sheets was conducted in an environment having a temperature of 25° C. and a humidity of 50% to evaluate the photoreceptor drum for image defects due to ghosting, fogging, a decrease in density, filming, a cleaning failure, scratches, etc. The results obtained are shown in Table 1. In the case where process cartridges respectively for black, yellow, and magenta were used, the same results were obtained.

Example 2

A photoreceptor was produced and evaluated in the same manners as in Example 1, except that a binder resin in which m:n was 80:20 and which had a weight-average molecular weight (Mw) of 50,000 and a number-average molecular weight (Mn) of 20,000 was used. The results obtained are shown in Table 1.

Example 3

A photoreceptor was produced and evaluated in the same manners as in Example 1, except that the compound represented by (1)-11 shown above was used as a charge-transporting material in place of the compound represented by (1)-2 shown above. The results obtained are shown in Table 1.

Example 4

A photoreceptor was produced and evaluated in the same manners as in Example 2, except that the compound represented by (1)-11 shown above was used as a charge-transporting material in place of the compound represented by (1)-2 shown above. The results obtained are shown in Table 1.

Example 5

A photoreceptor was produced and evaluated in the same manners as in Example 1, except that a binder resin in which m:n was 90:10 and which had a weight-average molecular weight (Mw) of 55,000 and a number-average molecular weight (Mn) of 23,000 was used. The results obtained are shown in Table 1.

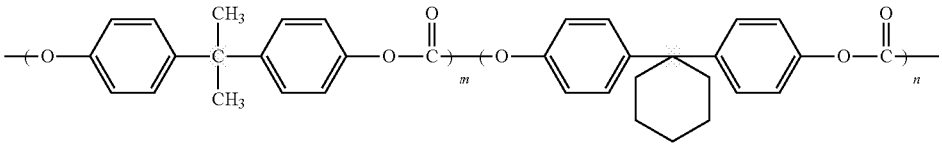

(4)-2

Example 6

A photoreceptor was produced and evaluated in the same manners as in Example 1, except that a binder resin in which m:n was 45:55 and which had a weight-average molecular weight (Mw) of 48,000 and a number-average molecular weight (Mn) of 19,000 was used. The results obtained are shown in Table 1.

Example 7

An image quality test was conducted in the same manner as in Example 1, except that a toner T2 having an average particle diameter of 6.0 μm and an average degree of circularity of 0.931 was used in place of the toner T1 used in Example 1. The results obtained are shown in Table 1.

Comparative Example 1

A photoreceptor was produced and evaluated in the same manners as in Example 1, except that a compound (4)-1 having the repeating structure shown below (viscosity-average molecular weight (Mv), 20,000) was used as a polycarbonate resin. The results obtained are shown in Table 1.

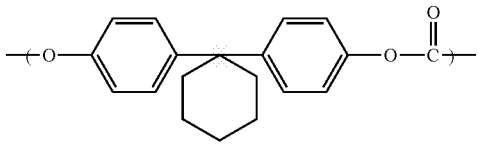

(4)-1

Comparative Example 2

A photoreceptor was produced and evaluated in the same manners as in Example 1, except that a homopolymer having the repeating structure (2)-6 shown above (weight-average molecular weight (Mw), 130,000) was used as a polycarbonate resin. The results obtained are shown in Table 1.

Comparative Example 3

A photoreceptor was produced and evaluated in the same manners as in Example 1, except that a compound (4)-3 having the repeating structure shown below (m:n=30:70; viscosity-average molecular weight (Mv), 30,000) was used as a polycarbonate resin. The results obtained are shown in Table 1.

Comparative Example 4

A photoreceptor was produced and evaluated in the same manners as in Example 1, except that a compound (4)-3 having the repeating structure shown below (viscosity-average molecular weight (Mv), 30,000) was used as a polycarbonate resin. The results obtained are shown in Table 1.

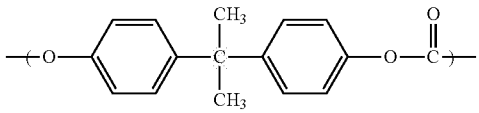

(4)-3

Comparative Example 5

A photoreceptor was produced and evaluated in the same manners as in Example 1, except that (5)-1 represented by the following structural formula was used as a charge-transporting material in place of the compound represented by (1)-2 shown above. The results obtained are shown in Table 1.

(5)-1

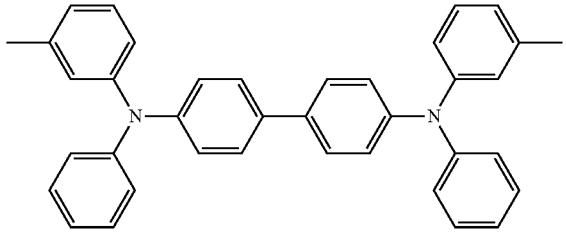

Comparative Example 6

A photoreceptor was produced and evaluated in the same manners as in Example 1, except that (5)-2 represented by the following structural formula was used as a charge-transporting material in place of the compound represented by (1)-2 shown above. The results obtained are shown in Table 1.

(5)-2

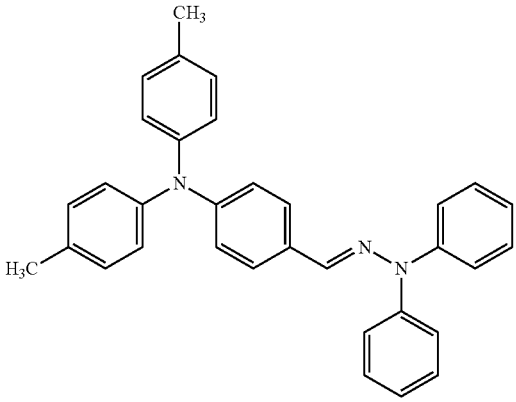

Comparative Example 7

A photoreceptor was produced and evaluated in the same manners as in Example 1, except that (5)-3 represented by the following structural formula was used as a charge-transporting material in place of the compound represented by (1)-2 shown above. The results obtained are shown in Table 1.

(5)-3

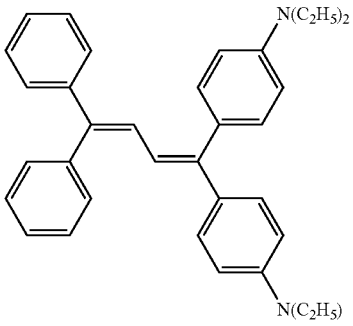

Comparative Example 8

A photoreceptor was produced and evaluated in the same manners as in Example 1, except that (5)-4 represented by the following structural formula was used as a charge-transporting material in place of the compound represented by (1)-2 shown above. The results obtained are shown in Table 1.

(5)-4

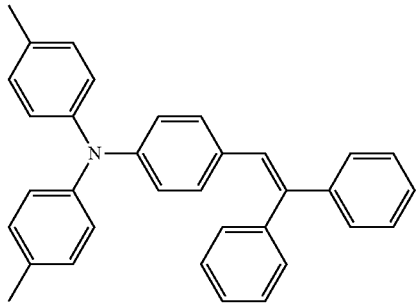

Comparative Example 9

A photoreceptor was produced and evaluated in the same manners as in Example 1, except that (5)-5 represented by the following structural formula was used as a charge-transporting material in place of the compound represented by (1)-2 shown above. The results obtained are shown in Table 1.

(5)-5

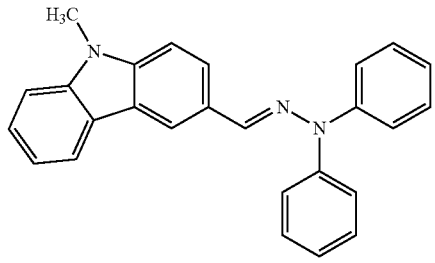

Comparative Example 10

A photoreceptor was produced and evaluated in the same manners as in Example 1, except that (5)-6 represented by the following structural formula was used as a charge-transporting material in place of the compound represented by (1)-2 shown above. The results obtained are shown in Table 1.

(5)-6

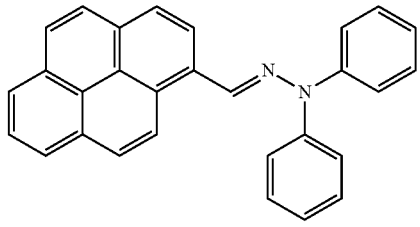

TABLE 1

| | Charge transporting material | Molecular weight of charge transporting material | Binder resin | $E_{1/2}$ ($\mu J/cm^2$) | VL (−V) |
|---|---|---|---|---|---|
| Example 1 | (1)-2 | 428 | (3)-1:(2)-6 = 67:33 | 0.12 | 48 |
| Example 2 | (1)-2 | 428 | (3)-1:(2)-6 = 80:20 | 0.12 | 45 |
| Example 3 | (1)-11 | 456 | (3)-1:(2)-6 = 67:33 | 0.12 | 46 |
| Example 4 | (1)-11 | 456 | (3)-1:(2)-6 = 80:20 | 0.12 | 42 |
| Example 5 | (1)-2 | 428 | (3)-1:(2)-6 = 90:10 | 0.12 | 44 |
| Example 6 | (1)-2 | 428 | (3)-1:(2)-6 = 45:55 | 0.12 | 55 |
| Example 7 | (1)-2 | 428 | (3)-1:(2)-6 = 67:33 | 0.12 | 48 |
| Comparative Example 1 | (1)-2 | 428 | (4)-1 | 0.12 | 57 |
| Comparative Example 2 | (1)-2 | 428 | (2)-6 | 0.13 | 70 |
| Comparative Example 3 | (1)-2 | 428 | (4)-2 | 0.12 | 60 |
| Comparative Example 4 | (1)-2 | 428 | (4)-3 | 0.12 | 49 |
| Comparative Example 5 | (5)-1 | 517 | (3)-1:(2)-6 = 67:33 | 0.12 | 56 |
| Comparative Example 6 | (5)-2 | 468 | (3)-1:(2)-6 = 67:33 | 0.12 | 43 |
| Comparative Example 7 | (5)-3 | 519 | (3)-1:(2)-6 = 67:33 | 0.12 | 66 |
| Comparative Example 8 | (5)-4 | 452 | (3)-1:(2)-6 = 67:33 | 0.13 | 79 |
| Comparative Example 9 | (5)-5 | 376 | (3)-1:(2)-6 = 67:33 | 0.13 | 102 |
| Comparative Example 10 | (5)-6 | 397 | (3)-1:(2)-6 = 67:33 | 0.14 | 129 |

| | Universal hardness ($N/mm^2$) | Percentage elastic deformation (%) | Image evaluation | Remarks |
|---|---|---|---|---|
| Example 1 | 235 | 42 | good | |
| Example 2 | 248 | 43 | good | |
| Example 3 | 230 | 43 | good | |
| Example 4 | 238 | 42 | good | |
| Example 5 | 234 | 37 | good (slight cleaning failure) | |
| Example 6 | 240 | 43 | good | photosensitive layer peeled off partly |
| Example 7 | 235 | 42 | good | toner T2 was used |
| Comparative Example 1 | 202 | 40 | noise, filming | |
| Comparative Example 2 | 265 | 42 | low image density, image abnormality due to photosensitive-layer peeling | photosensitive layer peeled off considerably |
| Comparative Example 3 | 196 | 38 | noise, filming, scratches, cleaning failure | |
| Comparative Example 4 | 191 | 35 | noise, filming, scratches, cleaning failure | coating fluid gelled partly |
| Comparative Example 5 | 188 | 41 | noise, filming, scratches | Crystals precipitated in film |
| Comparative Example 6 | 193 | 40 | noise | |
| Comparative Example 7 | 173 | 40 | low image density, noise | |
| Comparative Example 8 | 203 | 42 | low image density, noise | |
| Comparative Example 9 | 215 | 41 | low image density | |
| Comparative Example 10 | 209 | 41 | low image density | |

This application is based on Japanese patent application JP 2010-124833, filed on May 31, 2010, the entire content of which is hereby incorporated by reference, the same as if set forth at length.

What is claimed is:

1. An electrophotographic photoreceptor, comprising:

(I) a charge-transporting layer comprising:

(A) a charge-transporting material of formula (I):

(1)

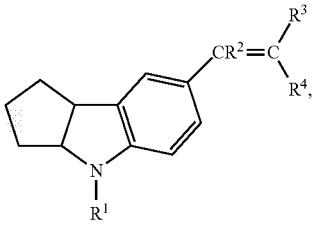

wherein:

$R^1$ is a phenyl group having one or two substituents;

$R^2$ is a hydrogen atom; and $R^3$ and $R^4$ are each independently an unsubstituted phenyl group or a phenyl group substituted with a methyl group; and (B) a copolymer binder resin of formula (4):

(4)

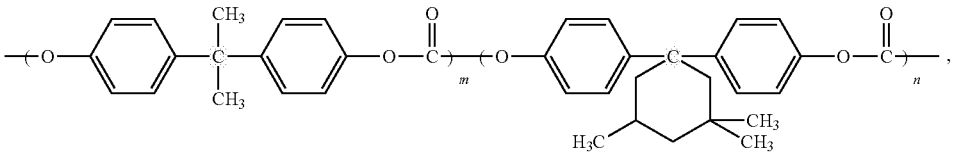

wherein m and n represent molar proportion, and m:n is from 90:10 to 45:55, and the copolymer binder resin of formula (4) has a weight average molecular weight of 40,000 to 100,000;

(II) a charge-generating layer comprising a charge-generating material; and (III) a conductive substrate, wherein the charge-transporting layer is the outermost layer.

2. The electrophotographic photoreceptor of claim 1, wherein, in formula (4), m:n is from 85:15 to 45:55.

3. An image-forming apparatus, comprising the electrophotographic photoreceptor of claim 1, wherein the image-forming apparatus comprises:

a charging unit, which charges the electrophotographic photoreceptor;

an exposure unit, which exposes the charged electrophotographic to light to form an electrostatic latent image;

a development unit, which develops the electrostatic latent image with a toner;

a transfer unit, which transfers the toner to a receiving object; and a cleaning unit, which cleans a cleaning blade counter-abutting on the electrophotographic photoreceptor.

4. The image-forming apparatus of claim 3, wherein the toner has an average degree of circularity, as determined with a flow particle image analyzer, of 0.930-1.000.

5. An electrophotographic cartridge, comprising:

the electrophotographic photoreceptor of claim 1;

a charging unit; and a cleaning unit comprising a cleaning blade.

6. The electrophotographic photoreceptor of claim 1, wherein, in formula (4), m:n is from 90:10 to 50:50.

7. The electrophotographic photoreceptor of claim 1, wherein, in formula (4), m:n is from 85:15 to 50:50.

8. The electrophotographic photoreceptor of claim 1, wherein, in formula (4), m:n is from 80:20 to 50:50.

9. The electrophotographic photoreceptor of claim 1, wherein, in formula (4), m:n is from 80:20 to 67:33.

10. The electrophotographic photoreceptor of claim 1, wherein, in formula (1), $R^1$ is a phenyl group substituted with a methyl group.

11. The electrophotographic photoreceptor of claim 10, wherein, in formula (1), $R^3$ and $R^4$ are each an unsubstituted phenyl group.

12. The electrophotographic photoreceptor of claim 10, wherein, in formula (1), $R^3$ and $R^4$ are each a phenyl group substituted with a methyl group.

13. The electrophotographic photoreceptor of claim 11, wherein, in formula (4), m:n is from 90:10 to 67:33.

14. The electrophotographic photoreceptor of claim 12, wherein, in formula (4), m:n is from 90:10 to 67:33.

* * * * *